US005315060A

United States Patent [19]

Paroutaud

[11] Patent Number: 5,315,060

[45] Date of Patent: May 24, 1994

[54] MUSICAL INSTRUMENT PERFORMANCE SYSTEM

[76] Inventor: Fred Paroutaud, 1316 Barry Ave., #9, Los Angeles, Calif. 90025

[21] Appl. No.: 824,114

[22] Filed: Jan. 17, 1992

Related U.S. Application Data

[63] Continuation-in-part of Ser. No. 433,652, Nov. 7, 1989.

[51] Int. Cl.[5] ..... G10H 3/18; G10H 7/00; G10H 3/14; G10H 3/00

[52] U.S. Cl. ..... 84/726; 84/11; 84/3; 84/603

[58] Field of Search ..... 84/2, 3, 9, 11, 83, 84/170-172, 115, 462, 601-603, 609, 645, 634, 639-643, 742, 743, 723, 725, 726

[56] References Cited

U.S. PATENT DOCUMENTS

| | | | |
|---|---|---|---|
| 1,739,799 | 12/1929 | Mills | 84/2 |
| 4,075,921 | 2/1978 | Hut | 84/738 |
| 4,744,281 | 5/1988 | Isozaki | 84/171 X |
| 5,070,759 | 12/1991 | Hoover et al. | 84/726 |
| 5,083,491 | 1/1992 | Fields | 84/21 |
| 5,092,216 | 3/1992 | Wadhams | 84/602 |
| 5,123,324 | 6/1992 | Rose et al. | 84/726 |
| 5,142,961 | 9/1992 | Parnutaud | 84/726 |

*Primary Examiner*—William M. Shoop, Jr.
*Assistant Examiner*—Jeffrey W. Donels
*Attorney, Agent, or Firm*—Hecker & Harriman

[57] ABSTRACT

In the present invention, performance sample passages are used as source material to drive the transducers of a controlled musical instrument, such as the strings of a violin. The performance sample passage method permits the faithful recreation of a musical performance without the limiting effects of speakers. Alternatively, analog/digital synthesizers, tape or other recording media, monophonic/polyphonic pitch recognition/-MIDI conversion methods or any electrical signals are used as sources to drive the transducers of a controlled instrument. The invention uses magnets with steel pole pieces positioned on either side of a transducer, such as a metallic string or rod of a controlled instrument. Said metallic string or rod can be either double or single anchored, or utilize any combination of anchoring means. Insulation between the pole pieces and magnets is utilized to isolate the coils from the magnets and pole pieces. String dampers are used to recreate a violin bow's damping and string focusing effects.

21 Claims, 16 Drawing Sheets

FIG. 5(a)
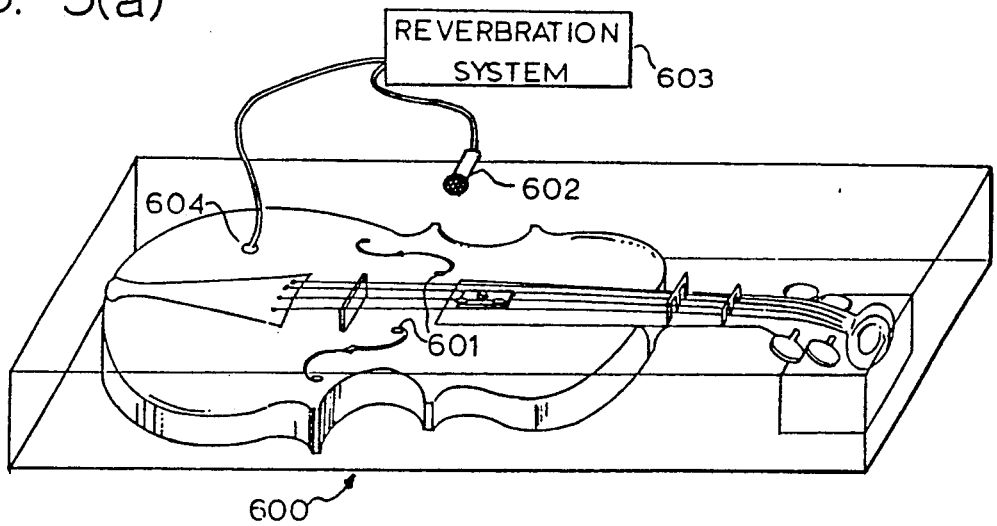
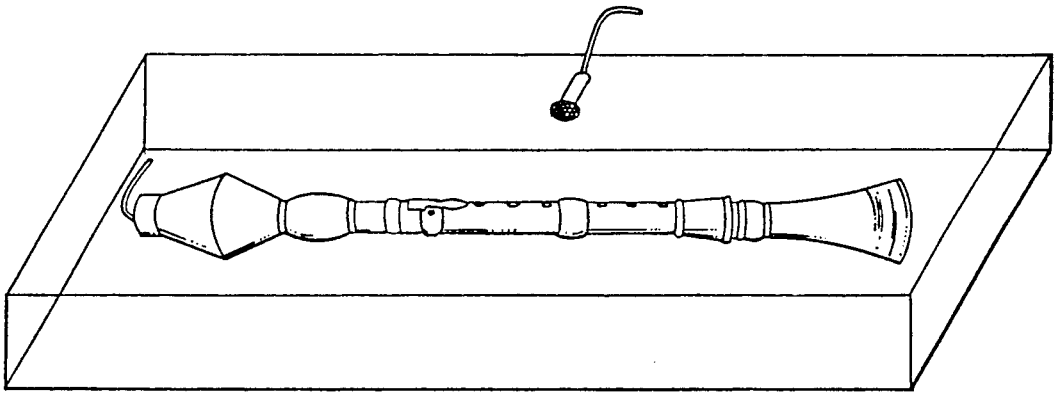
FIG. 5(b)
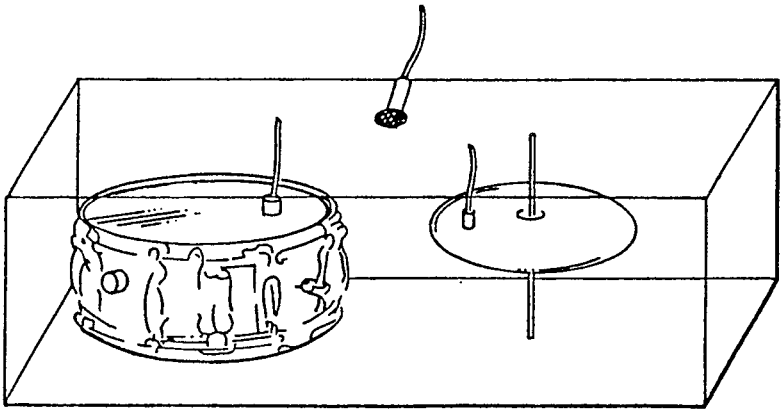
FIG. 5(c)

AS A COMPOSITION/PERFORMANCE TOOL

FIG. 13A
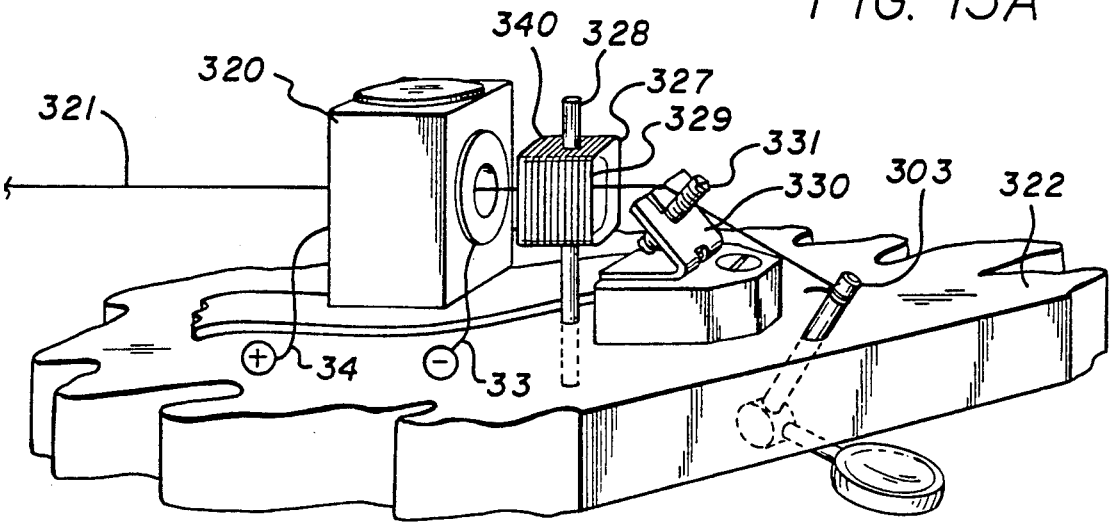
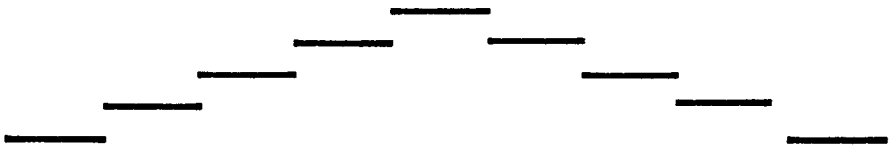
FIG. 14A
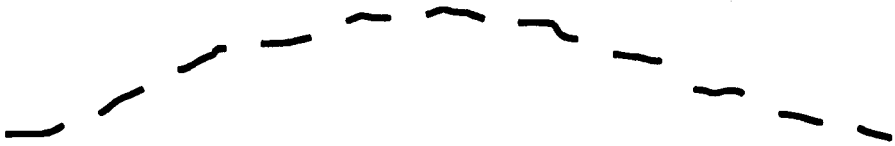
FIG. 14B
FIG. 14C
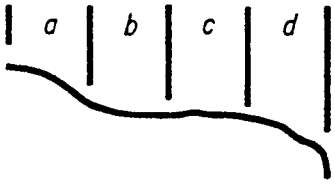
FIG. 14D FIG. 13B
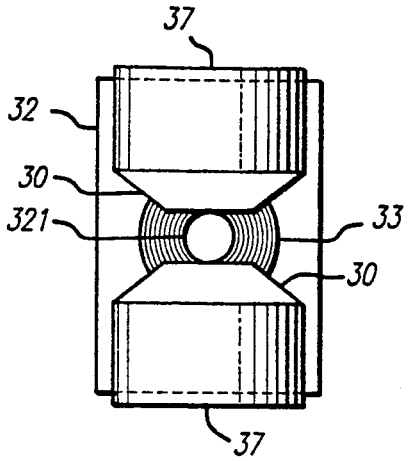
FIG. 13C
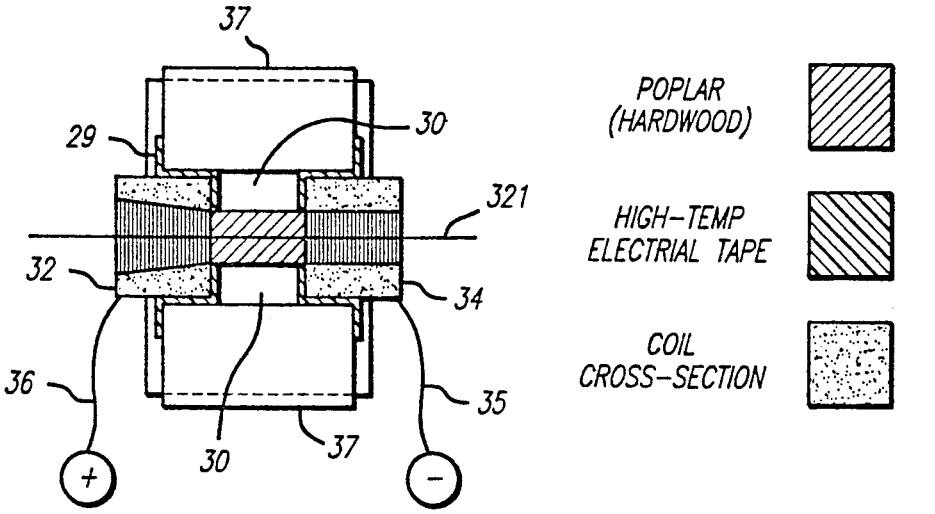
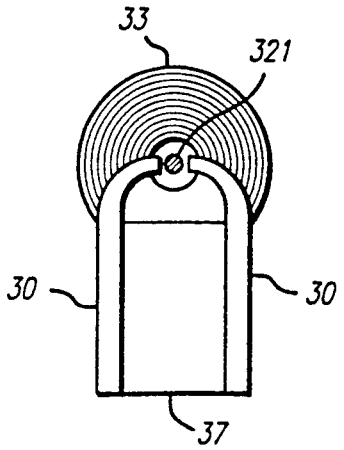
FIG. 13D

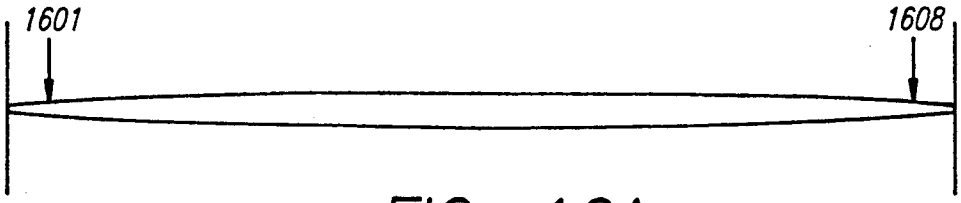
FIG. 16A
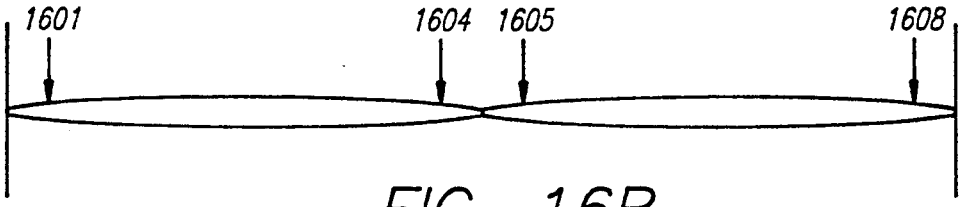
FIG. 16B
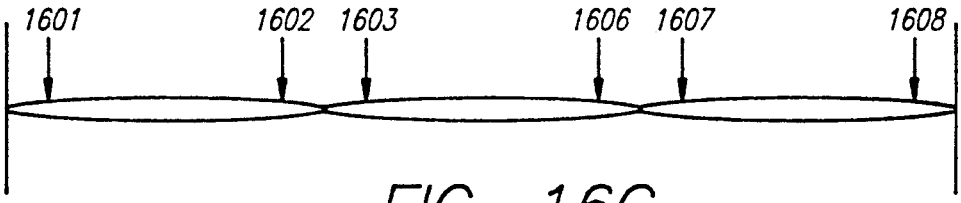
FIG. 16C
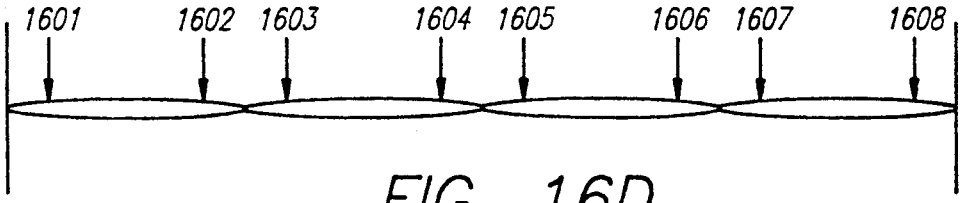
FIG. 16D
FIG. 16E
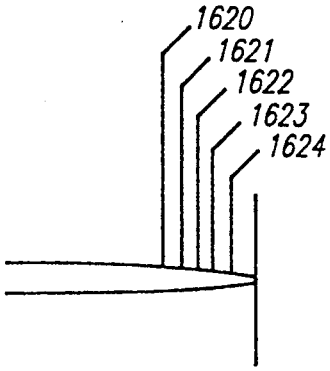

MUSICAL INSTRUMENT PERFORMANCE SYSTEM

This is a continuation-in-part of U.S. patent application Ser. No. 07/433,652 filed Nov. 7, 1989.

BACKGROUND OF THE PRESENT INVENTION

1. Field of the Invention

The present invention relates to systems of electromagnetic or electromechanical stimulation of acoustic musical instruments for the purpose of high fidelity production or reproduction of music.

2. Background Art

Acoustic instruments (i.e., non-electrical instruments) are the instruments of choice for performing most musical pieces. Acoustic instruments typically excite a moveable element near an air chamber to produce sounds. For example, in a violin, guitar or piano, strings are manipulated, excited and amplified by a sound chamber to produce sound; in a clarinet, oboe or saxophone, a reed is excited like a valve, and regulates a moving column of air down the bore of the instrument to produce sounds; in drums, a tightly-stretched membrane is excited and amplified by the drum body to produce sounds.

In the creation of recorded music, it is often desired to utilize acoustic instruments as part of the recorded performance. However, this often limits the repeatability of performances for recording and limits the venues where recording sessions can take place. For example, since acoustic instruments are recorded through the air, the acoustics of the recording locations are critical. This often prevents the use of a live acoustic performer when the recording is to be done at a small studio or a home environment. Further, if a large number of acoustic instruments are desired, the expense and logistics of supporting a large number of live performers is typically prohibitive. One prior art attempt to solve the problem of providing acoustic sounds for recording purposes is to substitute electronically-produced sounds such as from a synthesizer, sampler or the like. Mile such efforts can provide solutions to the problem of repeatability of performance, venues of recording sessions and expense, these prior art attempts do not provide satisfactory solutions to the problems of sound fidelity and authenticity. Synthesizers do not recreate strings or other acoustic instruments effectively, sounding artificial and lacking the richness and variety of live performers. High fidelity sampling techniques are expensive in terms of dollars and memory requirements, and also fall short of the real thing in terms of flexibility and acoustic authenticity.

There are methods in existence between the extremes of reproduction and live performance. The player piano, for example, is a device which can reproduce music on a real piano without the need for a human pianist. The player piano affords a composer with the convenience of storage and playback capability. Obviously though, the sounds producible by a piano cannot encompass other instruments such as strings or winds. Prior art player pianos are described in U.S. Pat. Nos. 4,843,936; 4,756,223; 4,744,281; 4,593,592; 4,469,000; 4,417,494 and 4,383,464.

Attempts have been made to record and reproduce a player piano musical performance synchronized with an orchestral recording. This complex mechanical reproduction, while a faithful reproduction of a piano, makes no attempt to faithfully reproduce other instrument groups, relying on the traditional loudspeaker for that purpose.

Presently, music is performed either acoustically or electronically or in combination, recorded through an electronic mixing board onto digital or sound tape and replayed electromagnetically through fiber speaker cones. Rarely, music is performed on a player piano, performance data being stored digitally, then replayed by a player piano mechanically reproducing the piano's real sound. In the case of electronic recordings, fidelity is lost during each step of the process. Even during the initial performance of the acoustic instruments, noise and distortion are introduced. Using the player piano method, an acoustic performance is reproduced mechanically with hammers and pedals, but only a piano is reproduced, mechanical delay is introduced and flexibility is lacking.

A preferred source material to drive a violin string is the "sample." A sample is generally the recording of a single musical note. This sample is a detailed "photographic" description of note attack, timbre, harmonic structure, sustain, volume and decay. A sample is a more complex structure, and contains more information, than waveforms typically generated by a synthesizer. When amplified and played back through a loudspeaker, a sample is indistinguishable from an original musical performance played through the same loudspeaker.

Samples are typically recorded one at a time, by slowly playing a scale of individual notes. The individual notes can subsequently be linked together in any desired order to create a new performance. One advantage of this method is that any sample can follow any other sample, creating an extremely flexible composition or performance environment tool.

However, there are a number of disadvantages to the single sample method. First, a single sample always starts with an attack, a crucial element of a musical sample. This attack may be adequate for some musical passages, such as those requiring individual attacks for each note. For other passages, such as legato or finger section, the single sample attack is inadequate. Second, the identifying "signature" of the single sample attack is always the same whenever that particular sample is played. This phenomenon is especially obvious when a specific sample is repeated. This sameness of attack is literally never found in the real world of acoustic instruments, where each attack is unique and different, always changing slightly, due to the human input. Third, because of the nature of current sampling technology, loops (the repeating of a sample section) are required. This looping can make a performance created from samples sound mechanical and artificial, because of the repetitive nature of the looping. In an actual performance, the same sound is rarely repeated.

SUMMARY OF THE INVENTION

This invention is an innovative system that creates, manipulates, mixes and recreates acoustic and acoustic hybrid musical instrument sounds and performances which are completely faithful to source instrument sounds and performances. This invention also provides a method of creating, manipulating, mixing and recording new and novel musical sounds.

As in the traditional orchestra, metal strings attached to sounding boxes, air columns within wooden or metal cylinders (straight or conical), membranes (drum skins), and pieces of metal, wood and plastic are relied on as sound sources and transducers. These instrument transducers are in turn precisely stimulated by computer-controlled electromagnetic, electromechanical and/or other devices (air pump, bow damper, etc.) to create and recreate both the authentic and rich traditional orchestral instrumental sounds as well as novel synthesized or hybrid sounds.

Each performance is controlled, edited, stored and recreated via a computer and recording medium. There is no fidelity loss and no noise or distortion is introduced at any time since the sounds are emanating from the instrument transducers themselves, not electronic devices and fiber loudspeakers. All the instruments of an orchestra or group can be faithfully reproduced.

Various types of instrument transducers are employed. Taut wires are vibrated inside electromagnetic coils and amplified and modified by a wooden chamber (creating string sounds such as violin, viola, guitar, cello, bass, etc.). Air columns inside wooden or metal cylinders as well as the wooden or metal cylinder are oscillated with an electromagnetic reed in conjunction with an air supply (creating "woody" sounds such as oboe, clarinet, bassoon, etc., and metallic sounds such as the saxophone). Air columns inside a metal cylinder as well as the metal cylinder are oscillated with an electromagnetic embouchure in conjunction with an air supply (creating metallic sounds such as piccolo, flute, trumpet, trench horn, trombone, tuba, organ, etc.). Stretched membranes are vibrated by an attached electromagnetic coil and amplified and modified by a wooden or metallic chamber (creating membrane sounds like snare drum, bass drum, timpani, tom-toms, congas, etc.). Pieces of wood, metal or plastic are vibrated by an attached electromagnetic coil (creating percussive sounds such as xylophone, triangle, glockenspiel, etc.). The air column within an artificial larynx is oscillated by an electromagnetic vocal cord in conjunction with an air supply (creating female voices, male voices, etc.).

In the preferred embodiment of the present invention, the output and/or performance information of an acoustic or electronic instrument is recorded and stored. The stored data is converted to MIDI (Musical Instrument Digital Interface) format and is used to drive an electromagnetic or electromechanical transducer of an acoustic instrument and/or a synthesizer/sampler. Performance information from a MIDI keyboard or other controller is combined with the stored performance data to create a new performance independent of the stored data or to modify the stored data. A CPU is used to edit and create sequences to provide output to drive the electromagnetic transducers. Alternatively, the original performance data can be provided from a recording or live performance of instruments.

In an alternate embodiment of the present invention, performance sample passages are used as source material to drive the transducers of a controlled musical instrument, such as the strings of a violin. The performance sample passage method permits the faithful recreation of a musical performance without the limiting effects of speakers. Alternatively, analog/digital synthesizers, tape or other recording media, or monophonic/polyphonic pitch recognition/MIDI conversion methods are used as sources to drive the transducers of a controlled instrument.

The alternate embodiment uses magnets with steel pole pieces positioned above and below a transducer, such as a metallic string, of a controlled instrument. Insulation between the pole pieces and magnets is utilized to isolate the coils from the magnets and pole pieces. String dampers are used to recreate a violin bow's damping and string focusing effects.

BRIEF DESCRIPTION OF THE DRAWINGS

FIG. 5 is an illustration of rack mountable acoustic instrument transducers.

FIGS. 13A–13D illustrate an alternate embodiment of violin string drivers of the present invention.

FIG. 14A–14D illustrate single and performance samples.

FIG. 16A–16E illustrates a plurality of damping locations in the present invention.

FIGS. 18A–18C illustrate alternate methods of implementing a needle/string combination.

DETAILED DESCRIPTION OF THE PRESENT INVENTION

Figure 1:
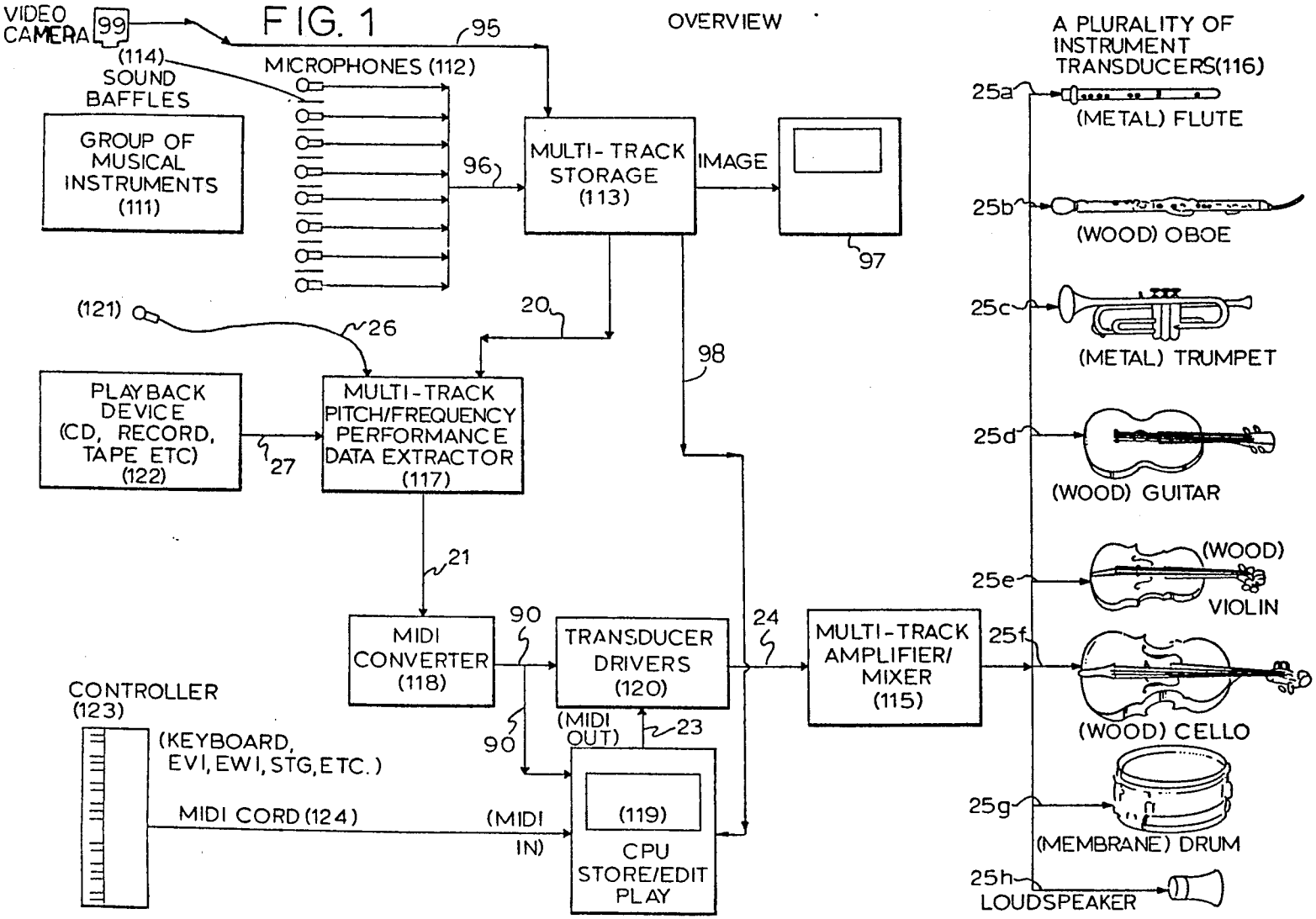
FIG. 1 is an overview block diagram of the present invention.

A musical production system consisting of creating, recording, processing and reproduction means is described. In the following description, numerous specific details are set forth in order to provide a more thorough understanding of the present invention. It will be apparent, however, to one skilled in the art, that the present invention may be practiced without these specific details. In other instances, well-known features have not been described in detail in order not to unnecessarily obscure the present invention.

The present invention is a system which accepts as input music from a source. That source can either be a plurality of acoustic and/or electrical musical instruments, a playback device such as a compact disk or magnetic tape player, or other sound sources which can be recorded by microphones. Data from such live or recorded sources is converted into MIDI format. There also exist instruments which can serve as source music suppliers whose performance data does not require conversion, because their output is preformatted to MIDI configuration. A signal in MIDI format can then be processed by a central processing unit (CPU), a computer which provides editing capabilities for the system. The CPU can transfigure signals to create diverse and interesting effects. Output of the CPU is also in the MIDI format.

In the description of the present invention, there are references to sound signal being converted to MIDI format. It will be understood that any format similar to MIDI may be used. In addition, any other suitable format for signals may be utilized without departing from the scope and spirit of the present invention.

Transducer drivers and other electric devices coupled to acoustic instruments de-convert the MIDI signals to the component parts which are necessary to drive the various instrument transducers that serve as output devices. The input to the transducer drivers can either be directly from a MIDI converter for live or recorded signals, or from a controller which has as output a MIDI-formatted signal. From the transducer drivers, some extracted and separated signals pass through a multi-track amplifier and mixer which in turn drives each instrument transducer with the appropriate extracted signal, while other MIDI signals control other electric devices such as electromagnets, air pumps and electronic instruments.

Because actual acoustic musical instruments are driven by the MIDI signal, a "live" acoustic sound is created. The transducers and other devices of the respective acoustic instruments are excited by a MIDI signal in a way which faithfully recreates the playing of the instruments by a live performer. For example, a violin string is excited by a bow moved back and forth on the strings by a performer. The pitch of the vibrating string is adjusted by changing the length of the string such as when the performer presses the string against various points of the neck of the violin. The vibration of the strings excites the air in the air chamber created by the body of the violin to produce the violin's sound.

In the present invention, the strings are excited by electromagnetic transducers and made to vibrate much as if a bow was being moved across the strings. The pitch of the strings can be changed electronically by altering the MIDI signal pitch used to excite the strings as well as the length of the string. The present invention not only allows for realistic recreation of traditional acoustic musical instrument or string sounds, but also allows new sounds to be created. For example, on a traditional violin, the strings are in an inverted V configuration so that it is impossible for the bow to touch all of the strings at once, particularly the first and last strings. However, by electronically exciting the strings individually, any combination of the strings may be excited with corresponding new sounds created. Also, by electronically exciting a violin string with the sound pattern of a clarinet, a novel acoustic hybrid sound is created. In the present invention, the instrument transducers (e.g., strings of a violin, reed of a clarinet, diaphragm of a drum) are also referred to as "primary" transducers. The electromagnetic or electromechanical transducers are referred to as "secondary" transducers. The secondary transducer is used to excite the primary transducer to create the desired sounds.

FIG. 1 is an overview block diagram of one possible embodiment of the present invention. In FIG. 1, the music source is a group of musical instruments at 111, for example, an orchestra or a rock group. Microphones 112 detect the sound of each instrument in the musical performance (electric guitar, violin, bass, trumpet, soprano saxophone, snare drum and cymbal, for example) and record each instrument onto a separate channel of multi-track storage/synchronization block 113. Sound separation of each instrument is accomplished with a combination of careful microphone placement, sound baffle 114 placement, and even room separation, if necessary. Because of the nature of this invention, strict group isolation is not required. Some leakage may be desirable as this effect is faithful to acoustic principals.

The recorded signal 20 in multi-track storage 113 is coupled to data extractor 117. Image data can also be provided from storage 113 to a video display 97 via line 96. Data extractor 117 is a multi-track pitch/frequency/performance data extractor. The output 21 of multi-track data extractor 117 is coupled to MIDI converter 118. The output 22 of MIDI converter 118 is coupled to transducer drivers 120. The output 22 of MIDI converter 118 is also coupled to CPU 119. CPU 119 provides an output 23 to transducer drivers 120. The output 24 of transducer drivers 120 is coupled to multi-track amplifier/mixer 115. Amplifier/mixer 115 provides a plurality of outputs 25(*a*)–25(*h*) to drive the instrument transducers 116 of the various acoustic instruments. CPU 119 can be used to edit or manipulate the digital MIDI format data.

Referring again to FIG. 1, video synching of electronically-controlled acoustic instruments to a taped performance can be achieved with the present invention. The music source (group of musical instruments 111) is recorded "live." The performance is simultaneously recorded with the video camera 99 and the output 95 of the video camera is provided to multi-track storage 113. Multi-track storage/synchronization block 113 includes devices such as a multi-track audio recorder/reproducer synchronized to a video recorder/reproducer. The sound output, as described above, is provided to CPU 119. Video synchronization is provided on SMPTE synch cord 98 to the CPU to synchronize the video or other image reproducing or recording information with the audio output. The synchronized image signal derived from the storage block 113 is reproduced as a screen image on a CRT 97 via line 96 and is synchronized with the performances of the electronically-controlled acoustic instruments. It should be noted that the SMPTE synch cord 98 is not required when the instruments are driven directly from MIDI converter 118, the storage synchronization block 113 provides appropriate synchronization. Only when audio data is edited in CPU 119, is SMPTE cord 98 required.

The CPU 119 may be any general purpose computer or personal computer such as are available today. For example, a Macintosh computer manufactured by Apple Computer, Inc., may be used in the present invention. In addition, a number of commercially-available programs for editing and manipulating musical sequences may be advantageously used with the present invention. By way of example, a program such as "Performer" by Mark of the Unicorn, is suitable for use in manipulating and editing the MIDI signals provided by MIDI converter 118 or controller 123.

It will be understood that the present invention may be practiced without the use of the CPU. The output of the controller can be coupled directly to the transducer drivers. Similarly, the output of MIDI converter can be directly coupled to the transducer drivers to drive the secondary transducers of the individual acoustic instruments.

Another method of musical performance digital extraction is possible. Musical instruments 111 can be patched directly to performance data extractor 117 with a single microphone 121 via line 26, or another playback device 122 (electric audio player, CD, tape, etc.) via line 27. From there, the signal connector via line 21 connects to NUDI converter 118 and on to CPU 119 via line 22 where it can be stored or edited in a digital (MIDI) format, and then played through line 23 to transducer drivers 120, line 24 to multi-track amplifier/-mixer 115, and instrument transducers 116 via lines 25 for faithful reproduction of the acoustic and electronic instrument sounds.

Another method of musical performance digital extraction is available. Performance on controller 123 can be directly routed to CPU 119 using MIDI cord 124. Digital performance information in CPU 119 can be stored, edited and played via line 23 through transducer drivers 120, multi-track amplifier/mixer 115 via line 24, and instrument transducers 116 via lines 25 for faithful creation of acoustic instrument sounds. The output 124 of controller 123 can also be directly coupled to transducer drivers 120. The output 124 of controller 123 can be coupled directly to the transducer drivers through the CPU by creating an electronic link without any modification of the signal by the CPU. Alteratively, a separate connection directly to the transducer drivers may be implemented. Either system can be utilized without departing from the scope and spirit of the present invention.

Figure 2:
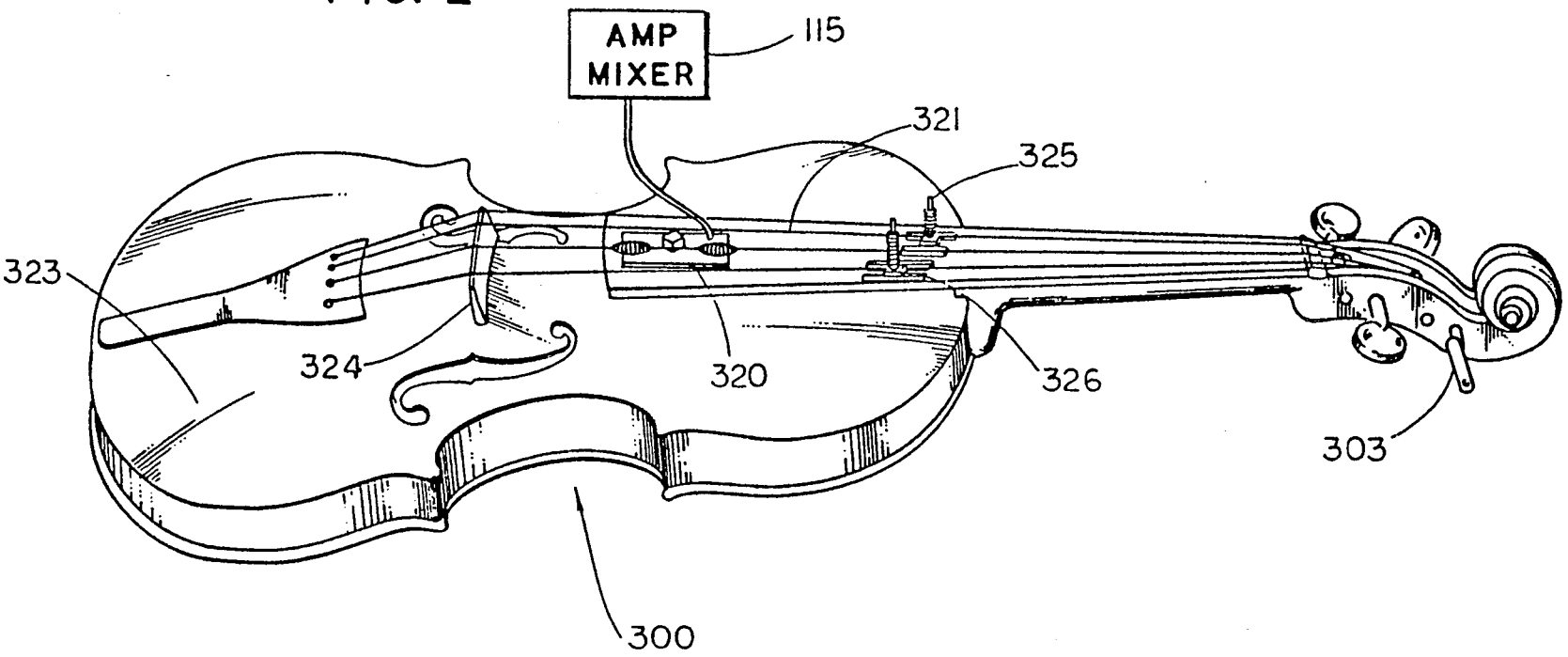
FIG. 2 is an illustration of a typical string instrument transducer assembly.

FIG. 2 is an illustration of a string instrument transducer assembly, in this case violin 300. The violin 300 consists of a main body portion 323 and an extended neck portion 322. The body 323 is typically comprised of wood and is hollow. A plurality of strings 321 are coupled to the violin body and extend over a bridge 324 mounted on the upper surface of body 323. The strings extend along the neck 322 to tighteners 303. The tighteners are screws or the like used to draw the strings taut and to "tune" the violin. When the strings are excited, the air within the body 323 vibrates and produces sound waves and ultimately the sound of the violin.

In the present invention, the strings are metallic and can be excited by an electromagnetic field. An electric coil/magnet assembly 320 energizes a selected metallic string 321 sympathetically with the incoming signal from amplifier/mixer 115. The incoming signal can either be a digitally-stored sample or a synthetic signal produced by a synthesizer. This energy vibrates the selected string 321, with the vibration being transferred to hollow wooden violin body 323 through wooden bridge 324. This action sets the entire violin 300 into an acoustic vibration distinctive to the violin. An adjustable string damper 325 interacts with the vibrating string 321, recreating the authentic violin sound. Violin string 321 works best when its length and tension matches or is a harmonic or "overtone" equivalent of the incoming signal from amplifier/mixer 115. A plurality of strings are desirable for a variety of sympathetic pitches.

Figure 10:
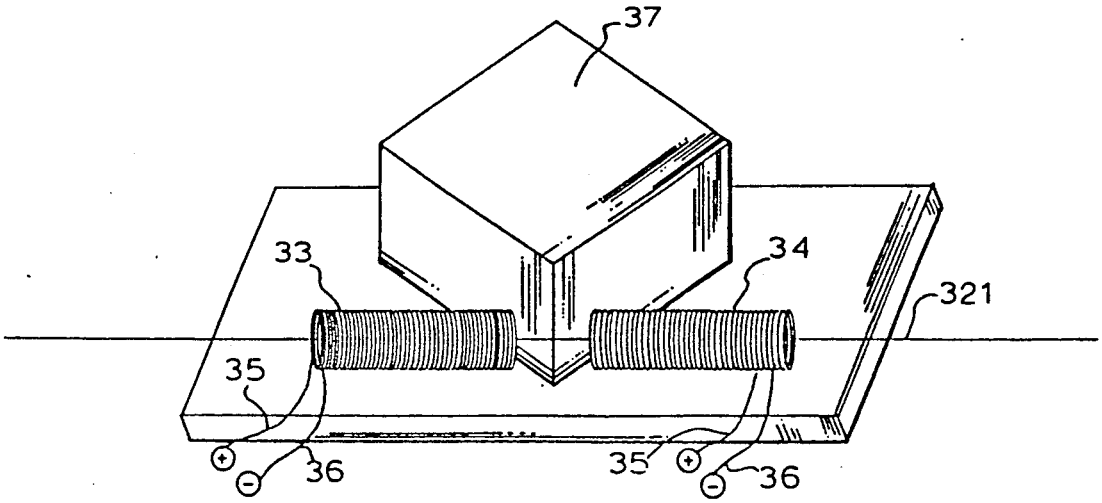
FIG. 10 illustrates the magnet/coil assembly of FIG. 2.

The coil magnet assembly is shown in detail in FIG. 10. The metallic string 321 is passed through coils 33 and 34 of coil magnet assembly 320. Coils 33 and 34 are comprised of 28–36 gauge copper enameled wire with an inner diameter of three-sixteenths to one-fourth peg side and nine thirty-seconds at the bridge side in the preferred embodiment of the present invention. It will be understood, however, that other types of wire and coil configurations can be utilized without departing from the scope or spirit of the present invention. In the preferred embodiment, a coil having a resistance of a minimum of 8 ohms has been found to be advantageous. The inner diameter of the coil should be such that the field generated can affect the metallic violin string 321. However, the diameter should not be so small that the metallic string contacts the coil, deadening its motion.

The cots are mounted to the stringed instrument body by epoxy or other suitable means and positive and negative lead lines 35 and 36 are used to electrically couple the coils to the signal output of the drivers.

A magnet 37 is positioned adjacent the metallic string so that the relatively small mass of the string can be moved and made to vibrate. In the preferred embodiment of the present invention, a rare earth magnet comprised of samarium or neodymium is utilized. In the present invention, the magnet 37 is polarized so that the upper surface is north and the lower surface is south. The string is positioned approximately half way between the upper and lower surfaces and a corner of the magnet is closest to the string, approximately one-eighth to one-fourth inch away from the magnet. The opening of the coils are approximately one-eighth inch from the magnet, as well. In an alternate embodiment, only a single coil is utilized.

Also, an electromagnetic finger 326 has been added to stop the associated string making it of a length and tension (tuning) to match or be a harmonic equivalent of a second pitch. Thus, with a single string and finger 326, one can obtain both the original string's pitch and harmonic equivalents, as well as the stopped string's pitch and harmonic equivalents. Thus, with 6 strings, all 12 pitches and harmonic equivalents of the musical scale can be sympathetically reproduced. Another method of obtaining all 12 pitches and their harmonic equivalents is obtained by utilizing multiple electromagnetic stopping fingers 326.

Figure 11:
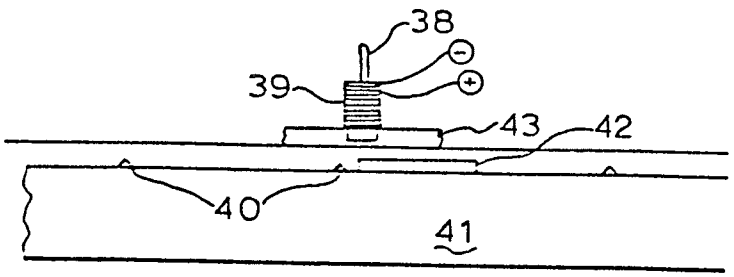
FIG. 11 illustrates the "finger" assembly of FIG. 2.

The electromagnetically activated "fingers" of the present embodiment are illustrated in detail in FIG. 11. The strings of a stringed musical instrument extend over a neck which has a number of frets 40. In normal operation, a user uses his fingers to press a string against a fret to shorten the string to affect the string's tension. The pitch of a stringed instrument is determined by the string's length, mass and tension. By pressing a string against a fret, the length of the string which is excited is changed, changing the pitch.

The present invention may use an electromechanical device to change string length. In the present invention, an electromagnet comprised of a metal core mounted within a coil assembly is positioned over a string. The core coil assembly may be positioned over the string by the use of spacers on either side of the string to support the assembly or it may be suspended with a super structure surrounding the neck of the stringed instrument. In the present invention, spacers 43 disposed on either side of the string 321 are used to support the core coil assembly. The core 38 is disposed within a coil 39. In the preferred embodiment of the present invention, the core 38 is an iron or steel rod with a flattened head member. The coil is such that 5 ohms of resistance are achieved although other resistances may be utilized. A metallic tab 41 is pivotally mounted at pivot point 42 so that the free end of the tab is substantially below the head of the core coil assembly. When a signal is provided to the coil, an electromagnetic field is created, drawing the metallic tab toward the head of the core coil assembly.

This catches the string between the head and tab, effectively shortening the length of the string and affecting pitch. The tabs are positioned at the nominal fret positions of a typical stringed instrument. If desired, a tab assembly is provided at each of the fret positions with a corresponding core coil assembly positioned overhead. In this manner, all pitch combinations which can be implemented by human fingers, can be duplicated in addition to others which are not possible because of the length limitations of human fingers.

Alternatively, the core coil assemblies could be disposed within the neck of the stringed instrument, and swinging tabs could be mounted above the string. The tabs could be spring-biased, be in an extended position and drawn down to hold the string when the core coil assembly is activated. The fret itself could be made to be an electromagnet to pull the string against it when activated. Or, an electromechanical hook could be used with a plunger device to pug the string against the neck at desired locations when activated. A coil/magnet assembly could be used to "lock" the string in position or to sympathetically interact with the incoming signal to stop the string.

Figure 3:
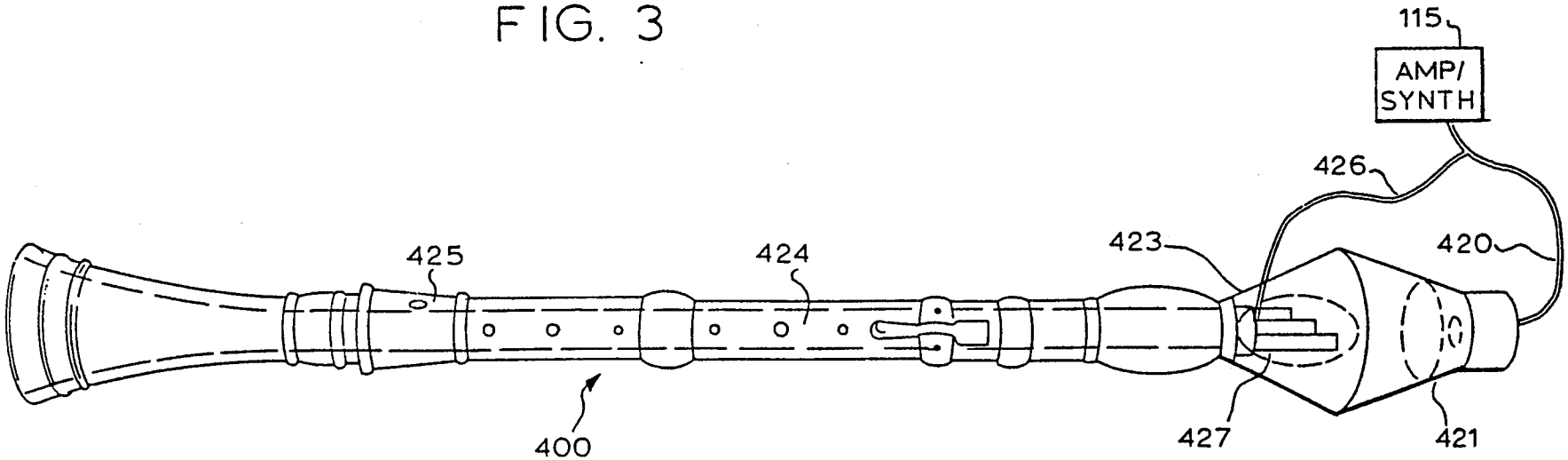
FIG. 3 is an illustration of a typical woodwind or brass instrument transducer assembly.
Figure 3A:
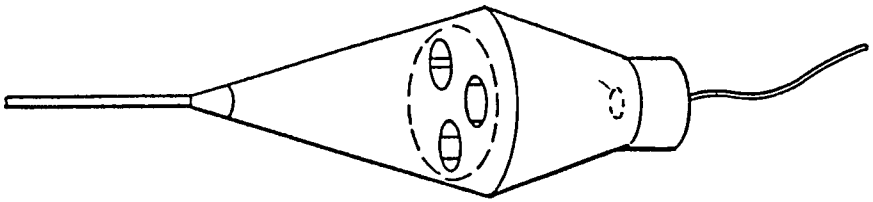

FIG. 3 is an illustration detailing a typical brass or woodwind instrument transducer assembly, in this case a clarinet 400. Air pump 401 forces air through air tunnel 402, mouthpiece 403 and wood body 404. Electromagnet coil 405 and rare earth magnet 408 open and close metallic reed "valve" 406 sympathetically with the incoming voltage configuration 426 from amplifier/mixer 115. Electromagnetic embouchure simulator 407 pushes on metallic reed valve 406 to control embouchure pressure. This vibrates the air column 424 in wood clarinet body 404. Next the vibration is transferred to wood clarinet body 404. This action sets the entire clarinet transducer assembly 400 into a vibration distinctive to the clarinet.

A woodwind instrument can be considered as three essential parts; a reed, a bore and side holes. Air blown into the instrument through the reed sets up vibrations in the column of air within the bore and this vibrating air column produces the sound of the instrument. The frequency at which the air vibrates is determined by the dimensions of the bore. These dimensions are modified in turn by the side holes in both their open and closed positions.

The reed system acts as a valve for replenishing the vibrational energy of the air in the bore by converting a steady flow of compressed air from a player's lungs into a series of puffs at the frequency dictated by the bore. Vibration of the reed opens or shuts the thin slit between the reed and the mouthpiece through which the air is blown into the bore. The frequency of vibration is set by the cyclic changes in the pressure of the vibrating air in the bore.

Figure 12A:
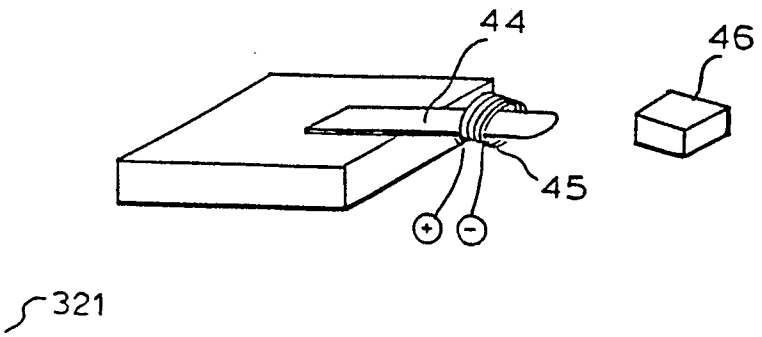
FIG. 12 illustrates the electromagnetically-activated reed assembly in detail.

Thus, an electromagnetically or electromechanically-controlled woodwind instrument requires a supply of air to function properly. The present invention uses an electromagnetically-activated reed assembly in connection with an air supply to produce a controllable and repeatable true woodwind sound. FIG. 12 illustrates the electromagnetically-activated reed assembly of the present invention in detail. The "reed" 44 is a thin metallic strip surrounded by a coil of wire 45. A rare earth magnet 46 is disposed near the reed (approximately one inch away). The electromagnetic coil is stimulated by the sampled or synthesized wind instrument signals and vibrates accordingly. The reed is coupled to a woodwind instrument such as a clarinet and an air supply is provided to pass over the reed and into the bore of the woodwind.

In the present invention, different pitches can be achieved by changing the pitch of the sampled signal used to stimulate the reed. That is, the side holes are not required to change the pitch of the woodwind instrument. Control of the reed's vibrations may be achieved with an electromechanical control the vibration of the reed much as users' mouth would do on a traditional woodwind. The embouchure simulator is moved adjacent to or abutting the reed to limit vibration and comprises a small rod or plunger "embouchure pressure attachment."

Figure 4:
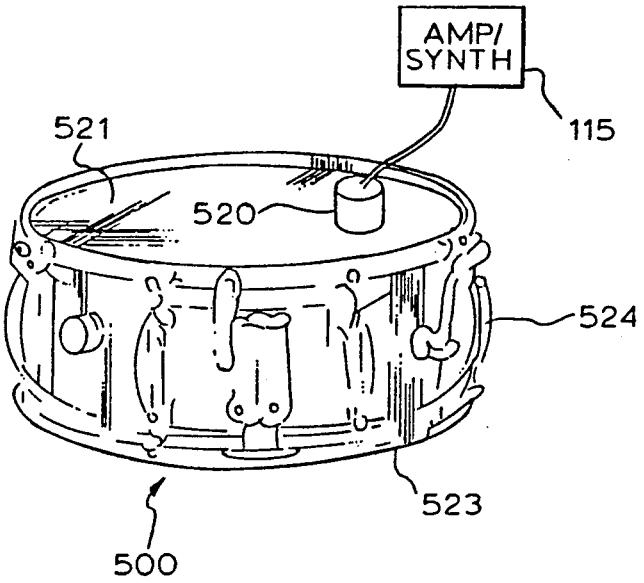
FIG. 4 is an illustration of a typical percussion instrument transducer assembly.

FIG. 4 is an illustration detailing a typical percussion instrument transducer assembly, in this case a snare drum 500. The drum 500 consists of a hollow cylinder body 524 and membrane/diaphragm 521. In the example shown, the drum body 524 is comprised of metal such as steel or aluminum. However, drums of wood or other material can be utilized as well. Typically, the drum body 524 is open on one end with the other end covered with a membrane/ diaphragm 521. The membrane 521 is stretched tightly across one end of the drum body 524 so that when the membrane is excited, the air column in the drum body is vibrated, producing a drum sound.

Coil/magnet assembly 520 energizes membrane vibrator diaphragm 521 sympathetically with the incoming voltage configuration from amplifier/mixer 115. This vibrates membrane 521 as well as air column 523 in metallic drum body 524, said vibration being transferred to hollow metallic snare drum body 524. This action sets the entire snare drum transducer assembly 500 into a vibration distinctive to the snare drum.

FIGS. 5A–5C illustrate several possible embodiments of rack-mountable acoustic instrument transducers with built-in microphone and pickup assemblies. The present invention may be used in a variety of locations of varying degrees of acoustic quality. Therefore, it is desired to configure the present invention to provide consistent environmental performance. The rack-mountable system of FIGS. 5A–5C is one solution to this problem. The rack system encloses each electronically-stimulated musical instrument in a box-like container. This allows stacking of a number of instruments, saving on space. Further, the box containers provide a consistent integral environment for each instrument, regardless of the external environment in which its used.

FIG. 5A illustrates a possible configuration for a stringed instrument such as a guitar, violin, bass, etc. In this case, since rack box 600 constitutes its own room reverberation environment, the sound emitted by the instrument transducer from sound holes 601 is picked up by microphone 602 and delivered to reverberation system 603 where the desired room reverberation is added. Instrument transducer sound can also be picked up at the condenser microphone pickup 604 and be sent to the reverberation system 603 where the desired room reverberation is added. FIG. 5B illustrates the same principal for a woodwind or brass instrument, while FIG. 5C illustrates the same principal for percussion instruments.

Figure 6:
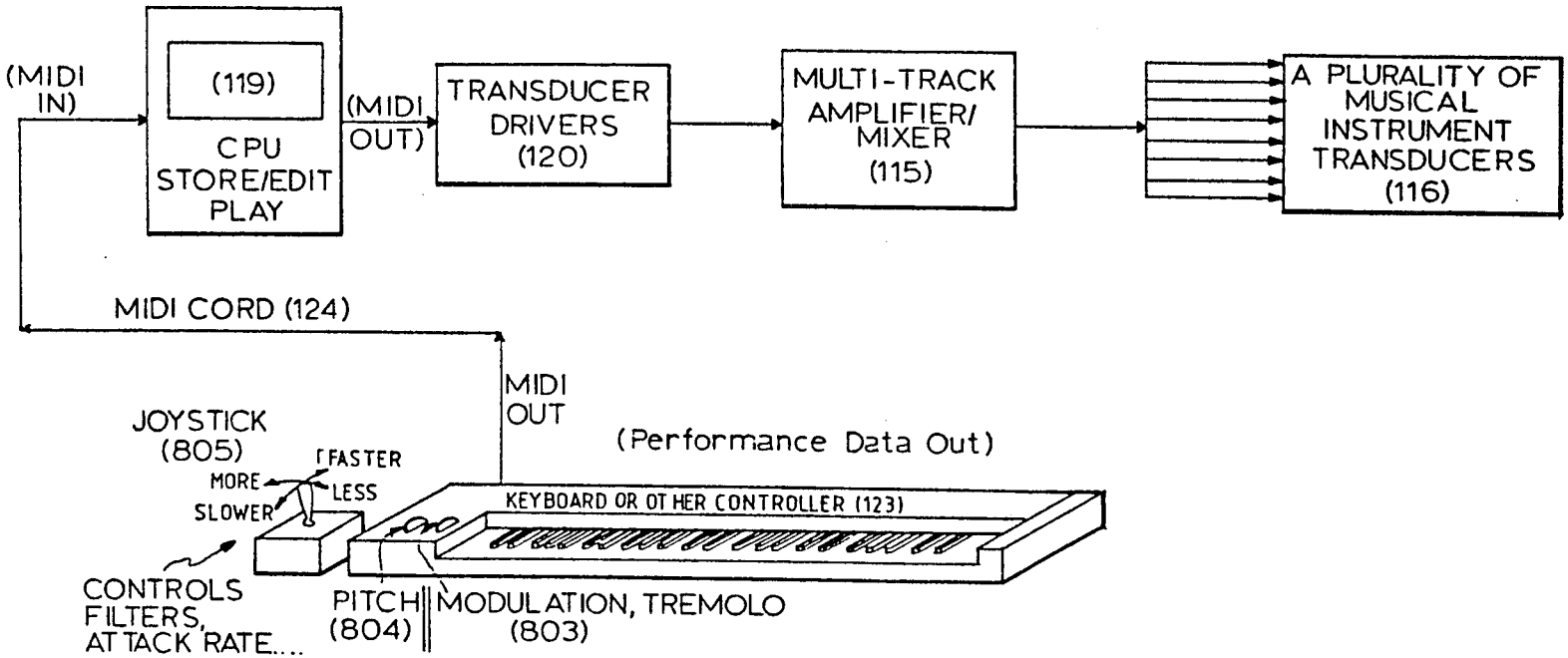
FIG. 6 is a block diagram for of the system as a composition/performance tool.

FIG. 6 is a block diagram of the system in FIG. 1 as a composition/performance tool. Performance on a keyboard or other controller 123 can be directly routed to CPU 119 using a MIDI cord 124. In this environment, every aspect of the musical performance, including note pitch, rhythmic placement, duration, velocity, attack, after-touch, modulation, pitch bend, filters and other synthesizer and sampler parameters can be controlled, recorded, edited and reproduced digitally in the CPU 119 and played through the transducer drivers 120, multi-track amplifier/mixer 115, and instrument transducers 116 for faithful reproduction of acoustic or acoustic hybrid instrument sounds. In this way, a musician can play any acoustic or acoustic hybrid instrument by simply making a track assignment in CPU 119 to any one of a plurality of acoustic or acoustic hybrid instruments 116.

The present invention uses a sample of a violin sound (the voltage pattern of a violin sound) to vibrate a metallic string like a violin string. A controller, such as a keyboard or a CPU, is used so that the sound can be controlled. The string, when excited by a violin sound, "mirrors" the sound, that is, sounds the same as the sound that is input. Therefore, if only a single sample were used to excite the string, the string would produce the same sound every time. The present invention can be used to modify the tremolo, pitch bend, modulation, attack, decay, etc., of the sound so that performances can be created on the electronically-controlled acoustic instruments. Generally, MIDI controllers have wheel-like or joystick-like devices to control the synthesizer's characteristics. A joystick 805 can be utilized to translate acoustic violin actions and sounds into options such as strike hard with a bow, tremolo, play lightly, a fast bow, slow bow, muted, etc. It is well known how to control a joystick to produce different output voltages depending on the position of the joystick. The present invention utilizes this characteristic to provide different signal strengths to provide different characteristics of the modified and electronically-controlled acoustic instruments. The keyboard of a controller itself is utilized to change the pitch of a sampled sound so that different pitches can be generated on the acoustic instruments.

Figure 7:
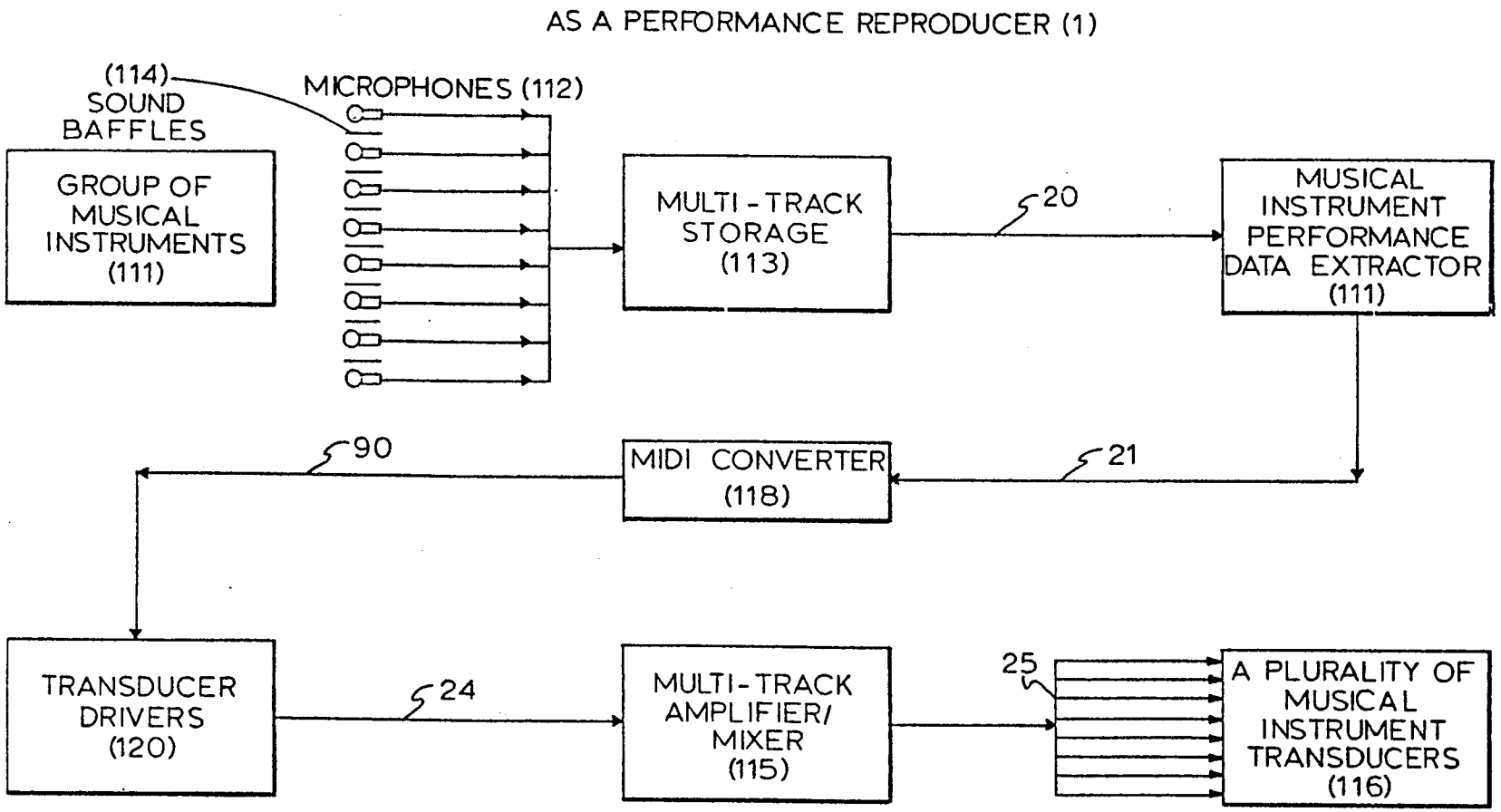
FIG. 7 is a block diagram of the system as a controlled multi-track performance reproducer.

FIG. 7 is a block diagram of the system functioning as a controlled multi-track performance reproducer. The sound of a group of musical instruments 111, (for example, an orchestra or a rock group) is detected by a plurality of carefully placed microphones 112 (one microphone each for electric guitar, violin, bass, trumpet, soprano saxophone, snare drum and cymbal for example). Each instrument is recorded onto a separate channel of multi-track storage system 113. Sound quality is retained by a combination of careful microphone placement, sound baffle 114 placement, and room separation if necessary. Strict group isolation is not required; leakage in this method is faithful to "real-world" acoustic principals.

From multi-track storage system 113, the recorded signal is sent via line 20 through instrument pitch/frequency performance data extractor 117, sent to converter 118 via line 21, converted to MIDI data, and sent to transducer driver 120 via line 22. From the multi-track amplifier 115 all sounds are directed via lines 25 to instrument transducers 116 for faithful reproduction of acoustic instrument sounds or acoustic hybrid sounds.

Figure 8:
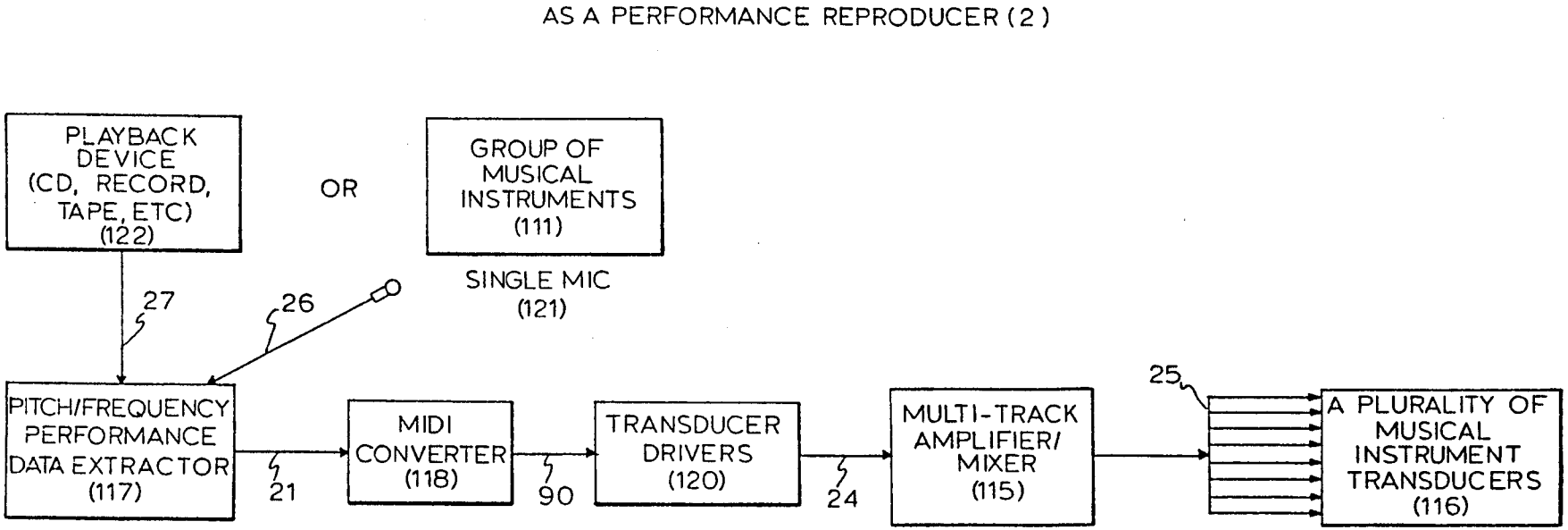
FIG. 8 is a block diagram of the system as a live or recorded performance pitch/frequency and performance data extraction system and reproducer.

FIG. 8 is a block diagram of the system in FIG. 1, configured as a live or recorded performance pitch/frequency and performance data extraction system and reproducer. The group of musical instruments 111 with a single microphone 121, or a playback device 122 can be patched directly to pitch/frequency performance data extractor 117 via line 27 or 26, then the MIDI converter 118 via line 21, and on to transducer drivers 120 via line 22 where the extracted signals are digitally reassembled, then via line 24 to multi-track amplifier/mixer 115, and via lines 25 to instrument transducers 116 for faithful reproduction of the acoustic instrument or acoustic hybrid sounds. In this system, automatic tracking/extraction device 117 will determine how instrument transducers 116 will sound.

The performance data extractor block 117 is used to extract pitch and performance data from input waveform signals such as produced as a result of a live musical performance. A number of pitch data extractors are described in the prior art such as in U.S. Pat. Nos. 4,841,827; 4,690,026; 4,688,464; 4,627,323; 4,479,416; and 4,432,096. Any of the devices described in those patents or any other suitable device may be used to remove pitch and frequency performance data from the sound signals produced from a live or recorded performance. As noted, a plurality of microphones 112 can be used to separate the performance into a series of "tracks" which can be extracted individually. Alternatively, the data extractor receives input from a single microphone or recording and extracts performance information.

Thus, the present invention has two methods for providing signals for use in exciting the secondary transducers of the controlled acoustic and acoustic hybrid musical instruments. In one method, a live or recorded performance is used to provide input to a pitch frequency performance data extractor where individual instrument sounds are extracted and used to stimulate corresponding controlled acoustic or acoustic hybrid instruments. In another method, a keyboard controller is used to create a sound or sound signal which is then provided to the secondary transducers. In either case, the sound source is converted to MIDI format and provided to multi-track synthesizer/sampler transducer drivers 120. The synthesizer/sampler transducer drivers 120 may be any commercially available model such as an Akai S900 or a Yamaha TX802. The synthesizer/sampler transducer drivers block 120 utilizes the MIDI input to create a synthesized or sampled sound which is provided to an amplifier mixer 115 for amplification. This amplified sound signal is used to stimulate the secondary transducers which in turn stimulate the primary transducers of the controlled acoustic instruments to produce sound.

Regardless of the sound source, the MIDI signals can be manipulated or edited by the CPU 119 although this is not required. The MIDI signals can be provided directly to the synthesizer/sampler block 120 if desired.

Figure 9:
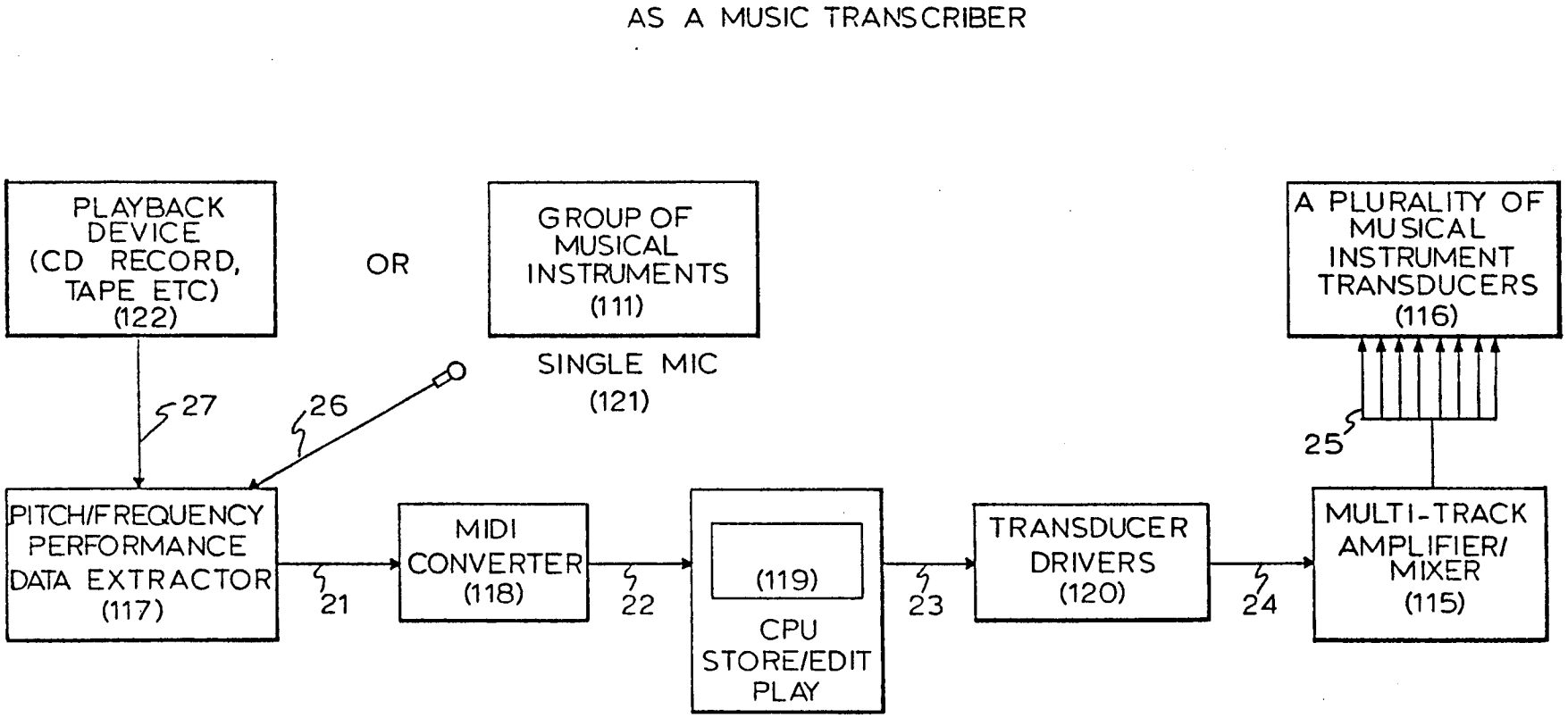
FIG. 9 is a block diagram of the system as a live or recorded performance transcribing, editing and reproduction system.

FIG. 9 is a block diagram of the system of FIG. 1 functioning as a live or recorded performance transcribing, editing and reproduction system. A group of musical instruments 111 with a single microphone 121, or playback device 122 can be patched directly via lines 26 or 27 to pitch/frequency performance data extractor 117, then to MIDI converter 118 via line 21, then into CPU 119 via line 22 where digital performance information in CPU 119 can be stored, edited and played via line 23 through transducer drivers 120, where the extracted signals are digitally reassembled, then via line 24 to multi-track amplifier/mixer 115, and via lines 25 to instrument transducers 116 for faithful reproduction of acoustic instrument or acoustic hybrid sounds.

The present invention allows acoustic performance reproduction of the following source performances; acoustic, acoustic and electronic or electronic. The present invention also allows the acoustic/electronic (i.e., synthesizer and sampler) reproduction of music from the following sources; acoustic, acoustic and electronic, and electronic. A combination or mix of electronically and mechanically stimulated acoustic musical instruments and electronic musical instruments is referred to as an "acoustic/hybrid" musical instrument.

PERFORMANCE SAMPLING

As mentioned above, a "performance sample" is a recording or sample of a continuous passage of solo instrument music, rather than separate and individual notes of music. This method of sampling retains much of the musicality and flow of performance-unique attacks, varied tremolos, slurs, bowings, fingerings, as well as other constantly variable elements that affect performance authenticity. These elements which are missing from the single sample approach.

In performance sampling, a passage of music is recorded and stored in a sampler. FIGS. 14A–D illustrate the typical pitch of a single sample and performance sample passage. The performance sample passage 14B is more realistic and less rigid than the single sample passage 14A. The pitch of the performance sample passage 14B contains all of the elements that make up general musical phrases such as expression, diversity, character, variance, etc.

After sampling, the performance sample passage is then divided into individual notes. The notes are sequenced in a computer to reassemble the performance, or to create a new performance. The individual "cut up" notes can be assigned to the appropriate sympathetic string of the violin of the present invention. In this description, the use of the present invention in driving a stringed instrument, such as a violin, is described. However, the present invention is not limited to stringed instruments, but may be applied to other transducer driven instruments as well.

Since a preferred embodiment of the present invention is based on sympathetic vibration, the single sample 14C, having a steady pitch pattern, matches sympathetically to its associated string. This can result in a steady and noise free sympathetic vibration. As shown in FIG. 14D, however, the performance sample creates an unsympathetic vibration in section "A," resulting in noise, a truer sympathetic vibration in section "B," the beginning of noise in section "C," and very unsympathetic noise in section "D," as the sample moves slightly toward the next note. The violin of the present invention can tolerate a certain amount of tuning "unsympatheticness" before performance degradation results. Thus, performance samples generally contain elements of unsympatheticness, but result in extremely realistic performances. Also, computer sample manipulation programs, such as Sound Designer from Opcode make it possible to fine-tune or taper individual performance samples to individual strings, virtually eliminating sample unsympatheticness. In comparison, single samples generally sympathetically match the string, but result in unrealistic performances.

DRIVING METHODS

There are five ways the player drives the violin of the present invention. The five sources of performance material are:

1. The controlled violin sample method;
2. The analog/digital synthesizer controller method;
3. The tape driven system;
4. The monophonic/polyphonic pitch recognition/-MIDI conversion method; and
5. The miscellaneous electrical signal method.

1. Controlled Violin Sample Method

In the controlled violin sample method, a keyboardist or other controller player utilizes a sampler stored with various individual violin samples to drive the violin of the present invention.

The main advantage of the sample method is that it gives spontaneity and flexibility to the performance. This is caused by the fact that any sample can follow any other sample in sequence to create new and original performances. The main drawback of this method is that currently a sampler can only hold a set number and diversity of samples, resulting in a certain sameness of sound during any particular performance. As samplers become increasingly complex, and as storage capabilities increase, samplers will be able to manipulate a greater number of samples, so that this limitation will be obviated.

2. Analog/Digital Synthesizer Controller Method

The analog/digital synthesizer controller method relies on the output of a synthesizer, (either analog or digital) to produce an output to drive the transducer of the controlled instrument. Analog/digital synthesizer controller players, principally MIDI violin, EWI (electronic wind instrument) and EVI (electronic valve instrument) players, are becoming more realistic and sophisticated as methods to control synthesizers advance and improve. These sophisticated methods result in sounds and performances with dynamics and range of expression rivaling acoustic players. The main drawback of this method is that the simplicity of synthesizer sound structure does not rival the sophistication of the sample. The sample is far more complex and ever changing, which results in a more realistic sound. The synthesizer-controller method is a suitable alternative, since the range of expression, varied attacks, dynamics, filter rates, legato and other "acoustic" techniques, are controllable to a high degree, resulting in realistic sounding performance. Also, synthesizers are increasingly utilizing samples in their attack structure, thereby greatly improving the realism of performance. In the driven needle embodiment (FIGS. 17–18), the synthesizer controller system is the method of choice, since the interaction of the moving bow mechanism, string, bridge and violin, rather than the sample, are relied on to recreate the complexity of a real violin sound.

3. Tape Driven System

The tape driven system can have a 14-track tape format (12 tracks for violin samples and two for accompaniment) that contains a series of prerecorded and assigned violin samples that drive the transducer of the controlled instrument, such as a violin. When using the tape driven system, each sample is carefully selected and tailored for optimum driving of the controlled violin. The EQ is set, tuning, timing, volume and timbre are adjusted and optimized. Entire performances can be recorded, analyzed by computer, cut up (note by note), adjusted (tuning and EQ) and sent to the appropriate string in this extremely controlled environment (performance sampling). The system permits computer enhancement and assures the retention of bowing, fingering, tremolo and other key violin performance nuances traditionally lost in individual note sampling. But instead of reproducing the sound two dimensionally, through speakers, the performance is "live" by driving the controlled instrument.

Each of the violin's twelve chromatic strings is controlled by a separate tape track that contains precise sample, pitch, volume, duration and modulation data (performance samples). When played back in conjunction with the other eleven tracks of information and eleven strings, this creates a complete acoustic violin performance. This performance is much higher in fidelity than a CD performance, since it relies on the actual violin vibrations as a final sound source instead of speaker cones. The performance is also more realistic than a traditional sampler/synthesizer MIDI performance, which also relies on speakers and generally uncomplex synthesizer and sampler sounds. The tape driven system can accommodate either single or performance sample types.

Furthermore, the tape driven system can eliminate the undesirable effect of "fundamental drone" that occurs during most overtone string driving (any pitch above the string's natural sympathetic pitch). Fundamental drone can be effectively eliminated with EQ adjustment for each pitch input to a string. Fundamental drone occurs because of the string always wanting to "speak" at its full length. For example, when the G2 string is stimulated with a G2 pitch, it sounds a pure G2. When a G2 string is stimulated with a G3 pitch, about ninety percent G3 and ten percent G2 is heard. The ten percent G2 is what is referred to as "fundamental drone." When EQ is introduced, effectively cutting out a particular offending bandwidth, the G2 "drone" is eliminated completely and G3 is sounded at 100 percent. It is difficult to program a sampler to eliminate fundamental drone for every available pitch because of the present day sampler limitations. However, the elimination of fundamental drone is possible in the tape driven system as the samples can be recorded on the tape individually or in small groups.

In another embodiment, fundamental drone is removed mechanically by lightly touching any non-end node with a dampening element, such as a pencil eraser. This prevents the string's full length from ringing through while focusing the specific overtone length.

4. Monophonic/Polylphonic Pitch Recognition/MIDI Conversion Method

The monophonic/polyphonic pitch recognition/-MIDI conversion method uses a CD, solo violin or other instrument recording, played into a monophonic (a single note at a time, not overlapping notes), or a polyphonic (several notes at once, many of which can overlap the following notes) pitch recognition/MIDI conversion device. This device translates the recorded performance information into MIDI performance data. This data can be either stored for future performance or editing, or sent directly to the violin via a sampler and amplification system for reproduction of the original performance. An advantage of this device is that any CD, tape, record or music storage device can be used as a performance source.

5. The Miscellaneous Electrical Signal Method

Any electrical signal can be fed to the secondary transducer, thereby stimulating the primary transducer. The source of the electrical signal is not necessarily a sample of music or a signal created by a musical instrument. The drive signal can be any signal that creates a sound when it is used to drive the secondary transducer and so stimulate the primary transducer.

Alternate Embodiment

Figure 15:
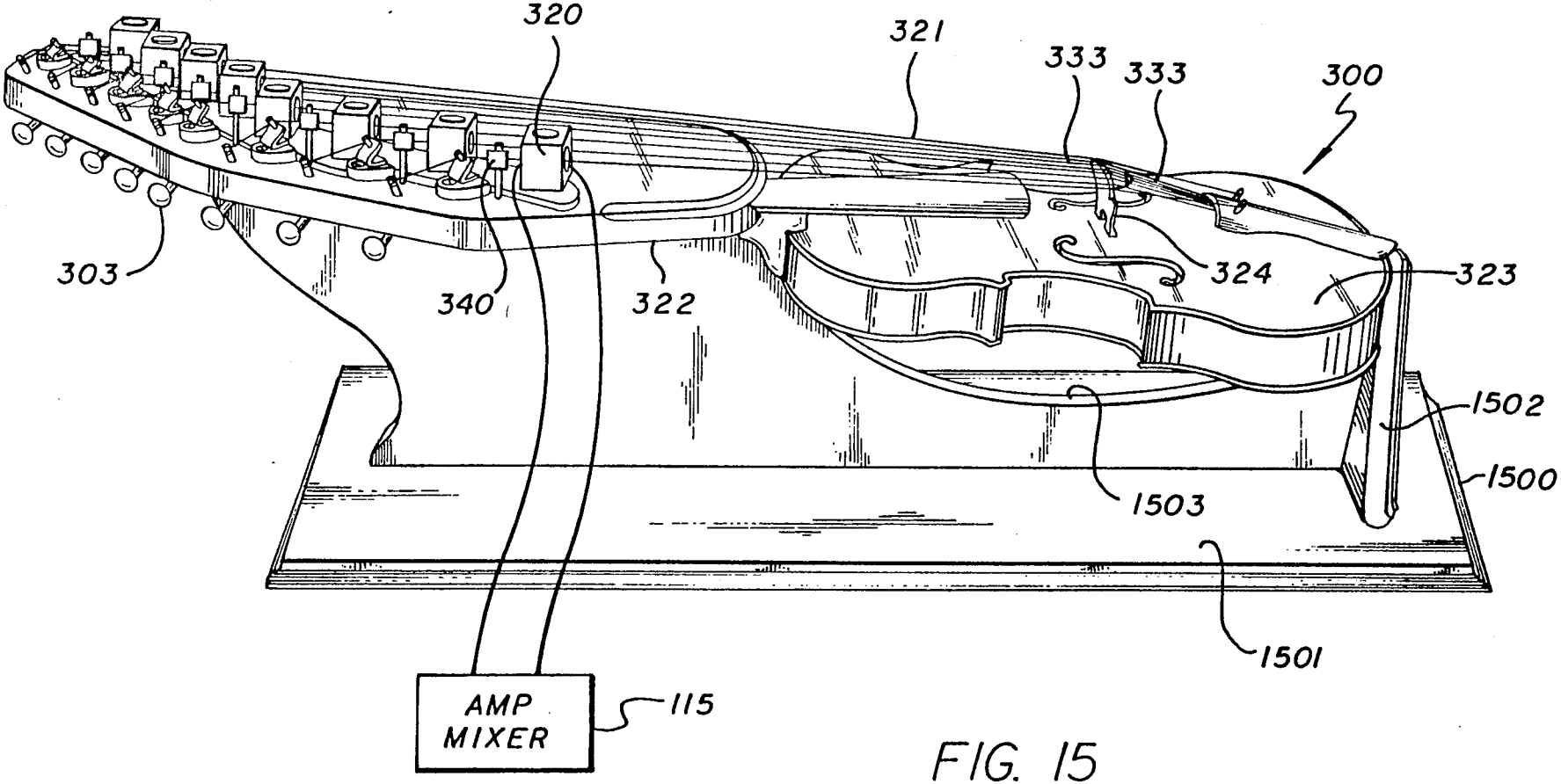
FIG. 15 illustrates an alternate embodiment of a violin controlled by the present invention.

An alternate embodiment of the present invention is illustrated in FIG. 15. A violin 300 is coupled to a mount 1500. The mount 1500 comprises a horizontally disposed base member 1501. An upright support member 1502 is mounted at one end of base 1501 and is substantially orthogonal to base 1501. A longitudinally disposed support member is mounted substantially orthogonal to both the base member 1501 and the upright support member 1502. The longitudinal support member 1503 supports the violin 300 in the air, so that sound may emanate from the violin in substantially all directions. The longitudinal member 1503 is formed such that the body 323 of the violin is free hanging, out of contact with other surfaces.

The violin includes a plurality of strings 321 coupled at one end of the violin and extending across a bridge 324, through rattle-dampening felt strips 333, and over a fingerboard 322. The strings 321 each extend through a coil magnet assembly 320 and string damper 340 (described in detail below) before terminating at a tuning peg 303.

In this alternate embodiment of the present invention, eight chromatic strings are provided. Each string is controlled by a separate driver coupled to an amp mixer, such as amplifier/mixer 115 of FIG. 15. In another embodiment, twelve chromatic strings are provided and mechanical dampers engage string non-end nodes, thereby eliminating fundamental drone (see under performance sampling).

A coil magnet assembly of this alternate embodiment of the present invention is shown in detail in FIGS. 13A–13C. A metallic string 321 is passed through coils 33 and 34 of coil magnet assembly 320. Coils 33 and 34 are comprised of 31 gauge copper enameled wire with an inner diameter of three-sixteenths at the tuning peg side and nine thirty-seconds at the bridge side in the preferred embodiment of the present invention. It will be understood, however, that other types of wire and coil configurations can be utilized without departing from the scope or spirit of the present invention. In the preferred embodiment, a coil having a resistance of a minimum of 8 ohms has been found to be advantageous. The inner diameter of the coil is such that the field generated can affect the metallic violin string 321. However, the diameter should not be so small that the metallic string contacts the coil, deadening its motion. The coils are insulated from the pole pieces and magnets by high temperature electrical tape 29.

The coils are mounted in wooden housing 32 by epoxy or other suitable means and positive and negative lead lines 35 and 36 are used to electrically couple the cots to the signal output of the drivers.

Magnets 37 with steel pole pieces 30 are positioned above and below the metallic string so that the relatively small mass of the string can be moved and made to vibrate. In the preferred embodiment of the present invention, rare earth magnets comprised of samarium or neodymium are utilized. In the present invention, the magnets 37 are polarized so that the upper surfaces are alternately north, south, north, south and the lower surfaces are south, north, south, north.

The string is positioned approximately half way between the upper and lower pole pieces, approximately one-eighth inch away from each pole piece. This arrangement drives the string vertically in relationship to the violin 300. In an alternate embodiment, only a single coil is utilized.

FIG. 13D illustrates an alternate embodiment in which a single magnet 37 is polarized north and south on a horizontal plane. Steel pole pieces 30 direct the magnetic flux to a point approximately one-quarter inch above the magnet and centered between the north and south poles. Metallic string 321 is passed through coil 33 and is driven horizontally in relationship to the violin 300. This horizontal string motion is faithful to the traditional violin's bowed string motion which acts to rock the violin bridge 324 from side to side. In an alternate embodiment, two coils are utilized.

In the present embodiment, string dampers 340 (FIG. 13A) are used to recreate the violin bow's damping and "stick-slip" effects. A piece of maple hardwood is carved into an elongated "U" shaped bracket 327 and a hole is drilled through to accept a piece of 10 gauge copper wire 328. This effectively holds the bracket 327 approximately one inch above the violin "fingerboard" 322, and adjacent to the violin string 321. Sturdy damping fiber material, such as unwaxed dental toss 329, is wrapped around the "U" shaped bracket 327 and is in contact with the violin string 321. This simulates the horsehairs of a real violin bow. The vertical motion of the string (driving magnets are above and below the string) necessitates a vertical damper bracket assembly to be faithful to the real violin bow's interaction with the real violin string. Dental floss wraps are spaced at 1 mm apart to effectively dampen the "end node" of each vibrating pitch. In an alternate embodiment, string damper assemblies are mounted horizontally to interact with the horizontal motion of the vibrating string.

This damping effect is illustrated in FIGS. 16A–16E. For example, a string excited with its matching fundamental pitch (i.e., G2 string excited with G2 electrical input) is best dampened and focused precisely at points 1601 and 1608, as shown in FIG. 16A.

Excited with its first harmonic (one octave up), it is best dampened and focused at any of positions 1601, 1604, 1605, and 1608 in FIG. 16B. Excited with its second harmonic (a fifth higher), the positions 1601, 1602, 1603, 1606, 1607, and 1608 of FIG. 16C are the best positions for damping FIG. 16D illustrates positions 1601-1608 for damping a string excited with its third harmonic (a fourth higher).

The preferred area to dampen the string is toward either end node, and at a slightly different spot for each harmonic. A node refers to the region of zero motion in a harmonically vibrated string, for example, midway along a string vibrated at its first harmonic. An "end node" refers to the general area where the string contacts either the bridge or nut. Referring to FIG. 16E, positions 1620–1624 illustrate a number of possible damping points for a string. Position 1620 dampens the fundamental, 1621 the first harmonic, 1622 the second harmonic, 1623 the third harmonic, 1624 the forth harmonic, and so on.

The string damper 340 of FIG. 13A effectively dampens the end node of each string harmonic without completely dampening the string (as a more solid damper would), thus focusing the stimulated violin string 321, resulting in a violin sound faithful to the original.

In another embodiment, string damper 340 rotates damping material 329 imitating the traditional violin bow motion. In this embodiment, sanded and rosined nylon fishing line is used to recreate the grabbing "stick-slip" effects of violin bow horsehair. It will be understood, however, that other types and configurations of damping material, including a traditional horsehair bow, can be utilized without departing from the scope or spirit of the present invention.

An adjustable violin nut 330 (nut refers to the end of the violin fingerboard where the string seats), controls the height of string 321 in relation to coils 33 and 34 by turning adjusting screw 331.

In the present embodiment, the taut string which is anchored at both the bridge and nut is referred to as double-anchored. The tension of a double-anchored taut violin string can be controlled either manually with tuning pegs (violin) or tuning machines (guitar) 303; with electric motors (U.S. Pat. Nos. 4,803,908, 4,791,849, 4,584,923 and 4,375,180); piezoelectric actuators, or "Pushers", (U.S. Pat. No. 5,009,142); or any other mechanical means, such as solenoids, hydraulic or pneumatic plungers. These methods are not useful for pitch selection, since the optimal string tension is soon abandoned, resulting in a strident (too taut) or dull (too loose) sound.

In another embodiment, an electromagnetic finger, such as those illustrated in FIG. 11, is added to stop the associated string, making it of a length and tension (tuning) to match or be a harmonic equivalent of a second pitch. Thus, with a single string and finger, one can obtain both the original string's pitch and harmonic equivalents, as well as the stopped string's pitch and harmonic equivalents. Thus, with 6 strings, all 12 pitches and harmonic equivalents of the musical scale can be sympathetically reproduced. Another method of obtaining all 12 pitches and their harmonic equivalents is obtained by utilizing multiple electromagnetic stopping fingers. These fingers can be operated by electric, hydraulic, pneumatic, magnetic fluid or any other mechanical means.

To summarize, pitch selection for a double-anchored taut string can be accomplished by changing string length with mechanical fingers (U.S. Pat. Nos. 4,722,260, 4,545,281, 1,147,504, 1,742,057 and 1,094,819), selecting from a number of piano-like varied length strings (U.S. Pat. No. 4,106,386), or vibrating string lengths with harmonic overtone frequencies as detailed above.

Alternate Embodiment No. 2

Figure 17:
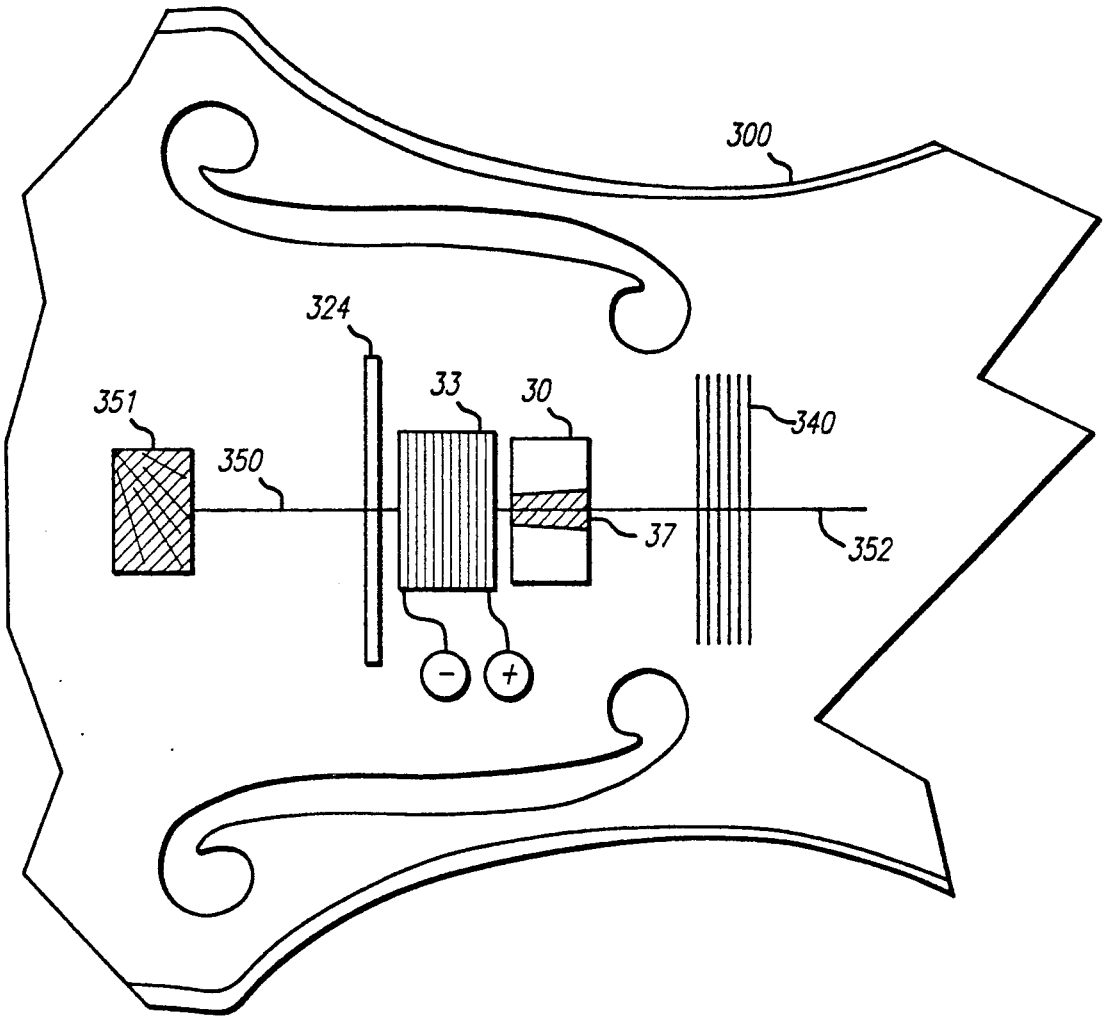
FIG. 17 illustrates an alternate embodiment of the present invention.

There exists another method of introducing string-like vibrations to the wooden violin bridge. FIG. 17 illustrates how a needle or rod 350, which is secured at one end 351, and extends over the violin bridge 324 in the manner of the taut string, may be similarly vibrated or driven by a secondary transducer comprised of coil 33, magnet 37 and pole pieces 30. As with the double-anchored taut string, the resulting vibration is transferred to the hollow wooden violin body 300 through the wooden bridge 324. The single-anchored needle or rod's unanchored end 352 is free to vibrate in mid-air, thereby minimizing its sympathetic characteristics and allowing it to be freely and precisely driven at any desired frequency. This precise and forced driving of the needle or rod makes possible sympathetic transference of any pitch, glissando, bend, altered note or tuning. Tuning is also automatic, relying on the input frequency rather than the length, mass and tension of the double-anchored taut string.

Like the driven taut violin string of FIG. 15, the vibrating action of the needle or rod is focused and dampened by the interaction of a stationary or moving bow mechanism 340, like those described earlier. This restores the well-known stick-clip buzzing action of the traditional violin arrangement.

Figure 18A:
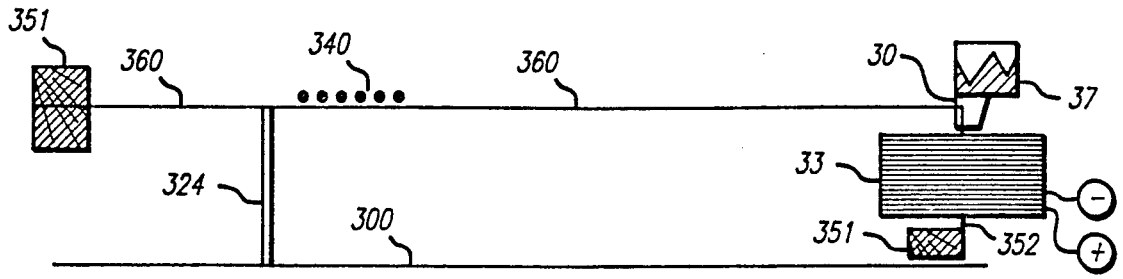

It is possible to combine the driven needle or rod and vibrating string to create a needle/string configuration. By placing the needle/coil arrangement of FIG. 17 vertically in relation to violin body 300, and attaching a string from the needle's tip to the violin bridge in a traditional manner, the single-anchored "endless string" configuration of FIG. 18A is created. This arrangement allows the single-anchored string 360 to be driven sympathetically at any desired frequency, making glissandos, bends, altered and automatic tunings possible. Bow interaction is again desirable to recreate the authentic violin stick-slip buzzing action.

The automatic pitch-driving characteristics of the needle/string configuration work best when string 360 (bridge-to-needle) tension is low. Higher tensions reintroduce the double-anchored taut string's characteristic fundamental or harmonic overtone sympatheticness when vibrated. However, this low tension string sounds dull in comparison to a real violin with double-anchored taut strings. Restoration of the characteristic bright sound quality, while maintaining driving flexibility and accuracy, is possible by substituting a "piano wire" rod for some or all of the string in the needle/-string configuration. This restores the characteristic high tension sound of the traditional double-anchored taut violin string while continuing to allow the "endless string" or automatic tuning properties of the low tension needle/string.

The physical structure of the traditional violin is well known and dictates that low frequency tones are best transferred to the violin body on the bass bar side (the G-string or left side) of the bridge, while tones of higher frequencies are best transferred on the sound-post side (the E-string or right side) of the bridge. FIG. 18B illustrates how, in the present embodiment, the lower tones are created by vibrating a four-inch length of 0.030-inch diameter piano wire rod 361 at the bridge end which is grafted to a four-inch long 0.030-inch diameter violin string 362 attached to the vibrating needle tip 352. This arrangement is effective from the lowest frequency tones of the controlling keyboard up to approximately two octaves above middle C (from approximately 20–1,000 cycles). This configuration simulates the mechanics of the traditional violin's 0.030-inch G-string arrangement.

Figure 18C:
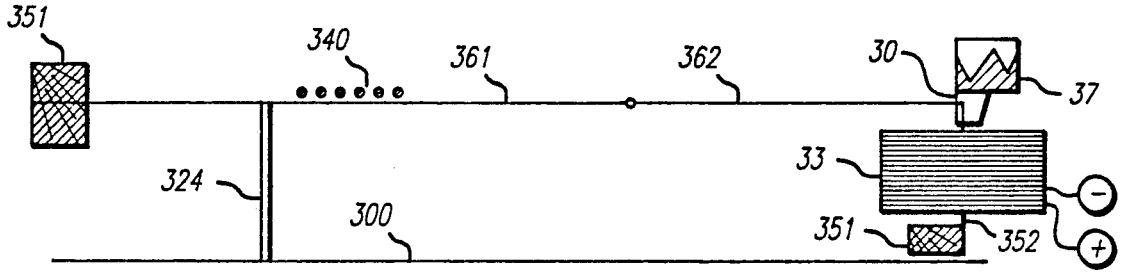
Figure 18C:
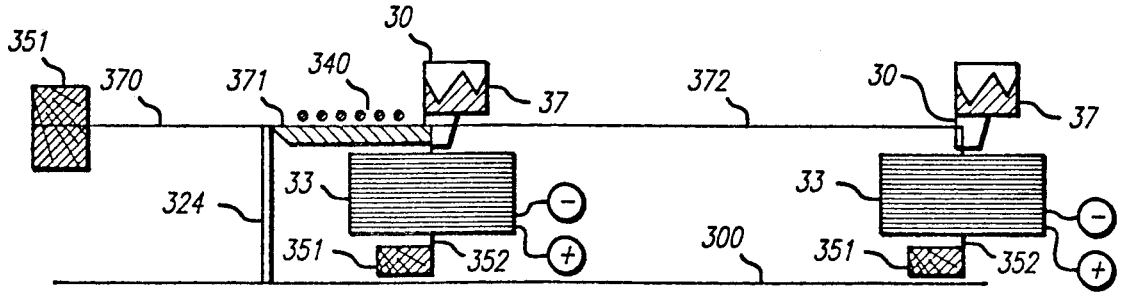

FIG. 18C illustrates how the range extending from approximately one octave above middle C (approximately 500 cycles) to the highest notes of the controlling keyboard are handled by extending a one-inch length of 0.010-inch diameter piano wire 370 over the right or sound-post or E-string side of the violin bridge 324 where it is grafted to a 1"×¼" length of 0.010-inch sheet metal 371 soldered to the tip of vibrating needle 352. The 0.010-inch diameter sheet metal is preferable to 0.010-inch diameter piano wire or violin string because it provides downwards bow interaction rigidity while maintaining a high degree of horizontal stick-slip flexibility. This configuration simulates the mechanics of the traditional violin's 0.010-inch diameter E-string arrangement.

By extending a 0.030-inch diameter length of piano-wire rod 372 from the 0.010-inch sheet metal length 372, it is possible to restore the full-bodied taut violin string sound. This added length can also be vibrated by a second vibrating needle arrangement, or left hanging in mid-air to vibrate freely.

The present invention allows for the grafting of any length and diameter or rod to any length and diameter of violin string and/or any length and thickness of sheet metal (or any other material) for the purpose of transferring vibrations to the violin bridge and into the violin body. At any point along its length, this composite "string" can be driven by any number of vibrating needle arrangements for the purpose of recreating the traditional violin sound or creating new and novel hybrid sounds. Any of these components may also be used independently to transfer vibrations to the violin bridge.

Thus, a method and apparatus for stimulation of acoustic musical instruments has been described.

I claim:

1. An electromagnetically stimulated violin comprising:

a violin having a plurality of strings, said violin mounted on a base having first and second upright support members such that said violin is supported out of contact of surfaces other than said first and second upright support members;

a plurality of coil magnet assemblies coupled to said violin;

a plurality of string dampers coupled to said violin;

each of said plurality of strings passing through one of said plurality of coil magnet assemblies and one of said plurality of string dampers;

signal generating means for producing a plurality of drive signals such that one drive signal is provided to each coil magnet assembly for electromagnetically exciting said string associated with each said coil magnet assembly to create sound from said violin.

2. The violin of claim 1 wherein said signal generating means comprises a sampler storing samples of violin performances.

3. The violin of claim 1 wherein said signal generating means comprises a synthesizer.

4. The violin of claim 1 wherein said signal generating means comprises a tape playback system, said tape playback system storing a series of violin samples.

5. The violin of claim 1 wherein said signal generating means comprises a pitch recognition/MIDI conversion device.

6. The violin of claim 1 wherein said coil magnet assemblies each comprise:

first and second coils of wire each having openings for receiving said wire, said first and second coils coupled electrically to said drive signals; and, first and second magnets mounted adjacent said first and second coils and each including metal pole members.

7. The violin of claim 6 wherein said first and second magnets comprise samarium magnets.

8. The violin of claim 6 wherein said first and second magnets comprise neodymium magnets.

9. The violin of claim 1 wherein said coil magnet assembly comprises a single magnet polarized north and south on a horizontal plane and a single coil having an opening for receiving said string.

10. An electromagnetically stimulated violin comprising:

a violin having a hollow body and having a bridge mounted on a surface of said violin, said violin mounted on a base having first and second upright support members such that said violin is supported out of contact of surfaces other than said first and second upright support members;

a rigid elongated transducer mounted to said violin body and extending over said violin bridge;

a coil magnet assembly coupled to said violin;

a damper coupled to said violin;

said rigid elongated transducer passing through said coil magnet assembly and said damper;

signal generating means for producing a drive signal such that a drive signal is provided to said coil magnet assembly for electromagnetically exciting said rigid elongated transducer to create sound from said violin.

11. The violin of claim 10 wherein said rigid elongated transducer comprises a rod.

12. The violin of claim 10 wherein said rigid elongated transducer comprises a needle.

13. The violin of claim 10 further including a string abutting said elongated transducer.

14. The violin of claim 10 wherein said signal generating means comprises a sampler storing samples of violin performances.

15. The violin of claim 10 wherein said signal generating means comprises a synthesizer.

16. The violin of claim 10 wherein said signal generating means comprises a tape playback system, said tape playback system storing a series of violin samples.

17. The violin of claim 10 wherein said signal generating means comprises a pitch recognition/MIDI conversion device.

18. The violin of claim 10 wherein said coil magnet assembly comprises:

first and second coils of wire each having openings for receiving said wire, said first and second coils coupled electrically to said drive signals; and, first and second magnets mounted adjacent said first and second coils and each including metal pole members.

19. The violin of claim 18 wherein said first and second magnets comprise samarium magnets.

20. The violin of claim 18 wherein said first and second magnets comprise neodymium magnets.

21. The violin of claim 10 wherein said coil magnet assembly comprises a single magnet polarized north and south on a horizontal plane and a single coil having an opening for receiving said string.

* * * * *